US010832523B2

(12) United States Patent
Guinn

(10) Patent No.: US 10,832,523 B2
(45) Date of Patent: Nov. 10, 2020

(54) CASINO BEVERAGE VALIDATION AND PAYMENT SYSTEMS

(71) Applicant: Ardent Progressive Systems and Games, LLC, Las Vegas, NV (US)

(72) Inventor: Robert Guinn, Henderson, NV (US)

(73) Assignee: Ardent Progressive Systems and Games, LLC, Las Vegas, NV (US)

( * ) Notice: Subject to any disclaimer, the term of this patent is extended or adjusted under 35 U.S.C. 154(b) by 0 days.

(21) Appl. No.: 16/416,588

(22) Filed: May 20, 2019

(65) Prior Publication Data

US 2019/0272708 A1 Sep. 5, 2019

Related U.S. Application Data

(63) Continuation-in-part of application No. 15/901,688, filed on Feb. 21, 2018, now Pat. No. 10,672,229, which is a continuation-in-part of application No. 15/151,395, filed on May 10, 2016, now abandoned.

(60) Provisional application No. 62/679,591, filed on Jun. 1, 2018, provisional application No. 62/601,070, filed on Mar. 10, 2017, provisional application No. 62/179,515, filed on May 11, 2015.

(51) Int. Cl.
*G07F 17/32* (2006.01)

(52) U.S. Cl.
CPC ..... *G07F 17/3255* (2013.01); *G07F 17/323* (2013.01)

(58) Field of Classification Search
CPC ..... G07F 17/323; G07F 17/3255
See application file for complete search history.

(56) References Cited

U.S. PATENT DOCUMENTS

| | | | |
|---|---|---|---|
| 4,837,728 | A | 6/1989 | Barrie et al. |
| 5,761,647 | A | 6/1998 | Boushy |
| 5,971,271 | A | 10/1999 | Wynn et al. |
| 6,003,013 | A | 12/1999 | Boushy et al. |
| 6,183,362 | B1 | 2/2001 | Boushy |
| 6,302,793 | B1 | 10/2001 | Fertitta, III et al. |
| 7,775,876 | B2 | 8/2010 | Rowe |
| 7,780,529 | B2 | 8/2010 | Rowe et al. |
| 8,452,687 | B2 | 5/2013 | Rowe |
| 8,979,646 | B2 | 3/2015 | Moser et al. |
| 2002/0187828 | A1 | 12/2002 | Benbrahim |
| 2004/0002386 | A1 | 1/2004 | Wolfe et al. |
| 2006/0073888 | A1 | 4/2006 | Nguyen et al. |
| 2009/0055205 | A1 | 2/2009 | Nguyen et al. |
| 2011/0306400 | A1 | 12/2011 | Nguyen |
| 2014/0256412 | A1 | 9/2014 | Colvin et al. |

(Continued)

OTHER PUBLICATIONS

Declaration of Robert Guinn, filed Jun. 18, 2018, 5 pages.
Search Report and Written Opinion for International Patent Application No. PCT/US2018/021205, dated Jun. 4, 2018, 16 pages.

*Primary Examiner* — Kevin Y Kim
(74) *Attorney, Agent, or Firm* — Weide & Miller, Ltd.

(57) ABSTRACT

Methods, systems, and devices are provided for validating player entitlement to a complimentary award or service (such as a complementary beverage), such as in a gaming establishment, and/or facilitating the patron's direct payment for such. A validation module at a gaming machine may indicate an award of a free drink or other comp to a player based upon meeting certain criteria, such as levels of wagering. A player might alternately purchase voucher at a gaming machine or kiosk and then use the voucher as payment for the drink.

19 Claims, 10 Drawing Sheets

(56) References Cited

U.S. PATENT DOCUMENTS

| | | | |
|---|---|---|---|
| 2015/0005060 | A1 | 1/2015 | Shankar et al. |
| 2015/0031444 | A1 | 1/2015 | Colvin et al. |
| 2016/0335846 | A1 | 11/2016 | Guinn et al. |
| 2018/0174399 | A1 | 6/2018 | Guinn |

CASINO BEVERAGE VALIDATION AND PAYMENT SYSTEMS

RELATED APPLICATION DATA

This application claims priority to U.S. Provisional Application No. 62/679,591, filed Jun. 1, 2018, and is a continuation-in-part of U.S. application Ser. No. 15/901,688, filed Feb. 21, 2018, which claims priority to priority to U.S. Provisional Application No. 62/601,070 which was filed on Mar. 20, 2017 and which is a continuation-in-part of U.S. application Ser. No. 15/151,395 which was filed on May 10, 2016, now abandoned, which application claims priority to U.S. Provisional Application No. 62/179,515 which was filed on May 11, 2015. The contents of said prior applications are hereby incorporated by reference as if set forth herein in its entirety.

BACKGROUND

Many gaming establishments that offer gambling (wager based games offered via gaming machines, at tables and the like) also offer complimentary awards to their patrons to encourage the patrons to continue wagering as consideration for the patrons' business. For example, gaming establishments may offer free beverages or food items to patrons while those patrons are playing wagering games at a gaming machine or gaming table.

Many gaming establishments have integrated player tracking systems that tie to the gaming machines and gaming tables. One of the purposes of such a system is to reward patrons for patronizing their location and gambling at their machines and tables. The player tracking system may award points to a patron based upon various criteria, such as amounts wagered, number of games played, wagering losses or the like. The patron may be allowed to redeem the points for free game play, reduced price or free goods or services or the like.

In addition, a gaming establishment may offer its patrons comps in the form of free beverages or food. For example, a server may serve free drinks to patrons who are playing games at gaming machines or gaming tables. In some cases, patrons may not be provided free beverages unless they are engaged in a minimum level of game play.

Due to the expense of providing complimentary rewards, operators of such gaming establishments often wish to ensure that the players are actually playing games at the machines, and not merely loitering at the location, before providing the complimentary rewards. In some instances, the operators may attempt to base complimentary gifts provided by hosts or bartenders on data received using the player tracking systems. However, even with such player tracking systems, it is difficult to determine and to communicate to a host or bartender which players are deserving of complimentary gifts.

For example, it is virtually impossible for a gaming establishment to manually track service of comps, such as drinks, to players of different gaming machines to ensure that enough time passes between serving comps and to ensure that the players are deserving of the comps. This is due to the sheer number of gaming machines and players at an establishment, as well as the fact that the player moves from gaming machine to gaming machine. The different establishment employees such as servers working in different areas of the establishment have no practical possibility of ensuring comps are consistently served at the right times to the right players.

At the same time, patrons who are not engaged in a minimum level of play or who might merely be socializing (such as watching a friend play) may desire a beverage. Serving these patrons is more complex given that the gaming establishment desires that these patrons pay for their beverages. The gaming establishment may require these patrons to travel to a bar or other service location to directly purchase a beverage. However, this can be frustrating to patrons because they have to leave their friends or the like. On the other hand, if the gaming establishment has the server deliver the drinks, the server must obtain cash payment from the patron which means that the server must either collect cash and be equipped to provide change and the like, or may have to travel back and forth to the bar to facilitate the patron's purchase.

An improved method and system for providing drinks or the like to patrons of a gaming establishment is desired.

SUMMARY OF THE INVENTION

Embodiments of the invention comprise methods, systems, and device for validating player entitlement to a complimentary award or service (such as a complementary beverage) in a gaming establishment, and/or facilitating patron payment for beverages or the like.

One embodiment of the invention comprises a method, system and device for validating player entitlement to complimentary or paid for awards or services, such as relative to a player of a gaming machine which presents wagering games at a gaming establishment.

In one embodiment, a validation system may include a gaming device comprising having a controller, at least one electronic display, at least one wager accepting device configured to receive a physical item representing a monetary value to increase a credit balance maintained at the gaming device, and at least one player input device configured to place a wager on a game of presented at the gaming device. The system also has a validation module connected to the gaming device. The validation module receives information from the gaming device of one or more wagers placed during the game presented at the gaming device via the at least one player input device. The validation module includes a visual notification output that provides a visual notification based on the information of the wagers placed to validate entitlement to awards or services to the player.

In some embodiments, the visual notification output is one or more LEDs. The validation module may provide the visual notification when an amount of funds associated with or input to the gaming machine reaches or exceeds a predetermined threshold. In another example, the validation module may provide the visual notification when an amount of wagers reaches or exceeds a predetermined threshold during a given time period.

Other configurations may also be used. For example, the validation module may provide the visual notification when an amount of the one or more wagers on average reaches or exceeds a predetermined threshold during a given time period. The validation module may also provide a first visual notification when an amount of the one or more wagers reaches or exceeds a first predetermined threshold, and a second visual notification when an amount of the one or more wagers reaches or exceeds a second predetermined threshold greater than the first predetermined threshold. Additionally, the validation module may provide a first visual notification when an average amount of the one or more wagers during a given time period reaches or exceeds a predetermined threshold, and a second visual notification when an average amount of the one or more wagers during a given time period falls below a predetermined threshold.

In another exemplary embodiment, a method for validating player entitlement to an award or services is provided. The method may include providing a gaming device comprising a controller, at least one electronic display, at least one wager accepting device configured to receive a physical item representing a monetary value to increase a credit balance maintained at the gamine device, and at least one player input device configured to place a wager on a game of presented at the gaming device. A validation module may be connected to the gaming device and may have at least one visual notification output.

The method may further include receiving information from the gaming device at the validation module of one or more wagers placed during the game presented at the gaming device via the at least one player input device. Based on the information received, the method may also include providing a visual notification via the visual notification output based on the one or more wagers placed.

In other embodiments, a validation module is provided that comprises a gaming device interface configured to send and receive information from a gaming device and a gaming system connected to the gaming device, at least one input device, at least one visual indicator; and an electronic control unit. The electronic control unit controls the gaming device interface, receives an input signal from the at least one input device, and activates the at least one visual indicator. The electronic control unit provides a visual notification via the at least one visual indicator to signify that the patron is eligible to be served or awarded another product (whether complimentary or paid for) based on the time since served value and the one or more wagers. The electronic control unit calculates a time since served or receives such information from a remote server for use in triggering the visual notification.

In one embodiment, the time since served value is reset when the electronic control unit receives the input signal from the at least one input device or via a remote server or from a secondary input device. The visual notification may be provided when an average amount of the one or more wagers during a given time period is greater than a first predetermined threshold, and when the time since served value is greater than a second predetermined threshold.

In other embodiments, a player might be awarded a comp based upon other criteria, such as based upon a promotion, based upon a status of the player, based upon a historical level of game play or the like. In these embodiments, information from a player tracking system or other information regarding a player or patron (such as based upon their identity as determined using captured image information or a player tracking card or ID) might be used to indicate entitlement of the comp.

Another embodiment of the invention comprises methods, systems and devices for facilitating a gaming establishment patron's payment of a beverage or the like. In one embodiment, a casino beverage payment system comprises one or more gaming machines which are configured to receive payment for and issue beverage vouchers, one or more kiosks which are configured to receive payment for and issue beverage vouchers, one or more voucher validation stations at which presented vouchers may be read, and a voucher validation server which is configured to generate beverage vouchers and validate beverage vouchers.

In one embodiment, if a player or patron is not entitled to a comp (such as free drink based upon game play level or the like), the player or patron may purchase a beverage voucher at a gaming machine or kiosk. The player or patron may then pay for a drink with a voucher, such as by presenting the voucher to a server. The server may scan the voucher at a validation station, which voucher is then validated at the voucher validation server. If valid, the voucher is accepted as payment for the drink (or other good/service).

In one embodiment, a player may provide funds to the gaming machine or kiosk (such as by inserting monies, a credit card or the like) to pay for a voucher. In other embodiments, a player might use player rewards points or credits at a gaming machine. In yet other embodiments, the system might include one or more portable payment processing devices by which a player may purchase a voucher or directly pay for a drink.

Additional aspects of the invention comprise methods, devices and systems for confirming eligibility of a player or patron to drink (such as by confirming the player or patron's age, such as by using facial recognition to confirm the identity of the person and their age).

Further objects, features, and advantages of the present invention over the prior art will become apparent from the detailed description of the drawings which follows, when considered with the attached figures.

DETAILED DESCRIPTION OF EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise systems, methods and devices for validating player entitlement to a complimentary award or service (such as a complementary beverage), such as in a gaming establishment, and/or facilitating the patron's direct payment for such.

One embodiment of the invention comprises a system, method and device for validating the complementary or paid for goods and/or services provided to players at a gaming establishment. In one embodiment, the validation comprises determining that a player is entitled to a free or reduced price good or service (which are often referred to as "complimentary" goods or services when such are free, or just a "comp") and providing a visual indication of the validation status.

Various criteria may be used to determine entitlement to a comp. As one example, the validation may comprise determining that the player has met certain game play activity requirements (past or present). In another embodiment, the validation may comprise determining that a certain amount of time has passed since a last award or service. In yet other embodiments, the validation may comprise a determination of a combination of factors such a passage of a period of time and certain game play requirements.

Aspects of the invention have particular applicability to gaming establishments—e.g. locations or businesses at which wager-based gaming activities are presented to patrons. Such locations are often referred to as or comprise casinos, but may also comprise taverns, restaurants, airports, ships and the like where gambling is permitted. As such, the method may be implemented, for example, relative to a gaming machine or device. Such a gaming machine may have various configurations.

Figure 1:
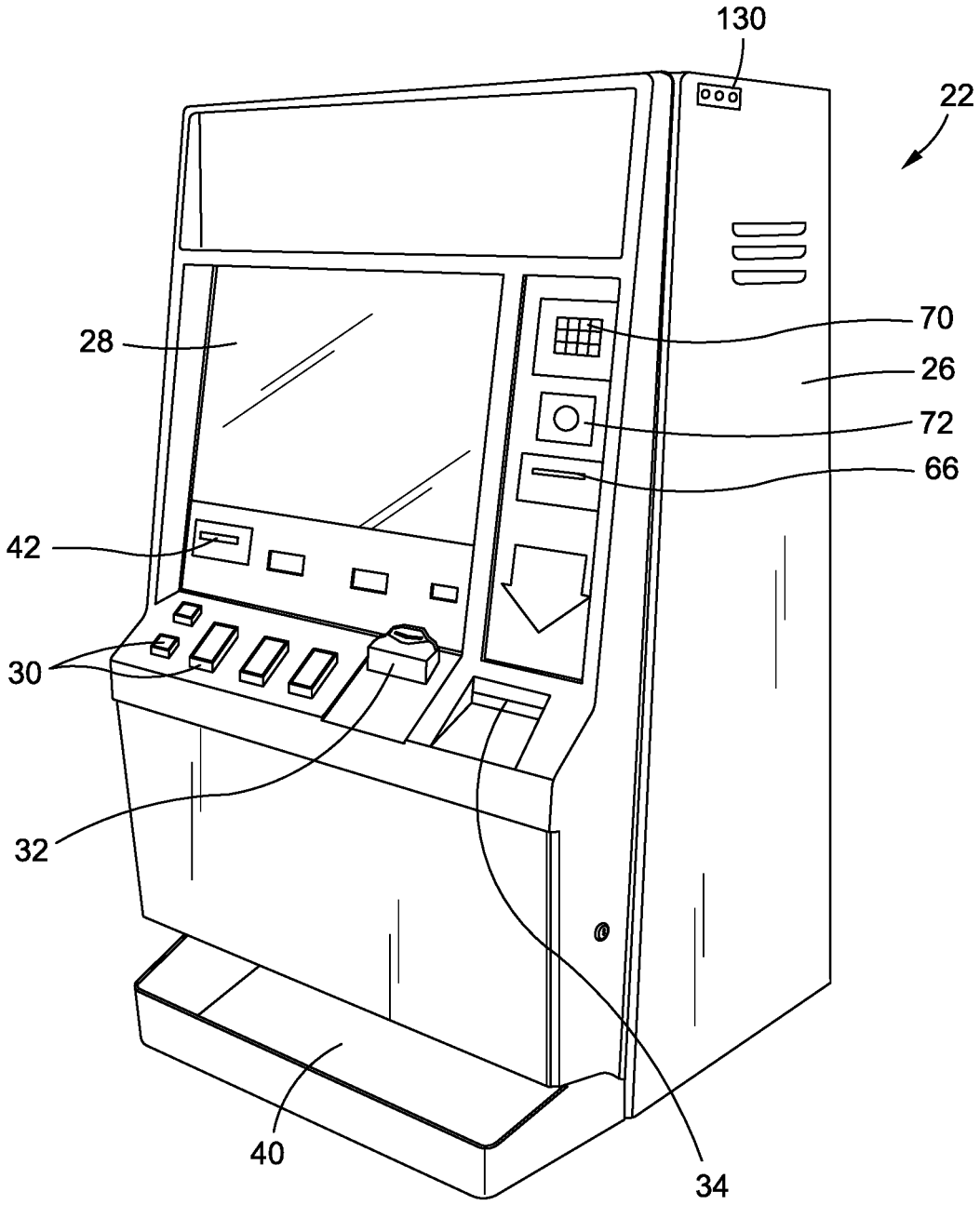
FIG. 1 illustrates a gaming machine according to one exemplary embodiment.
Figure 2:
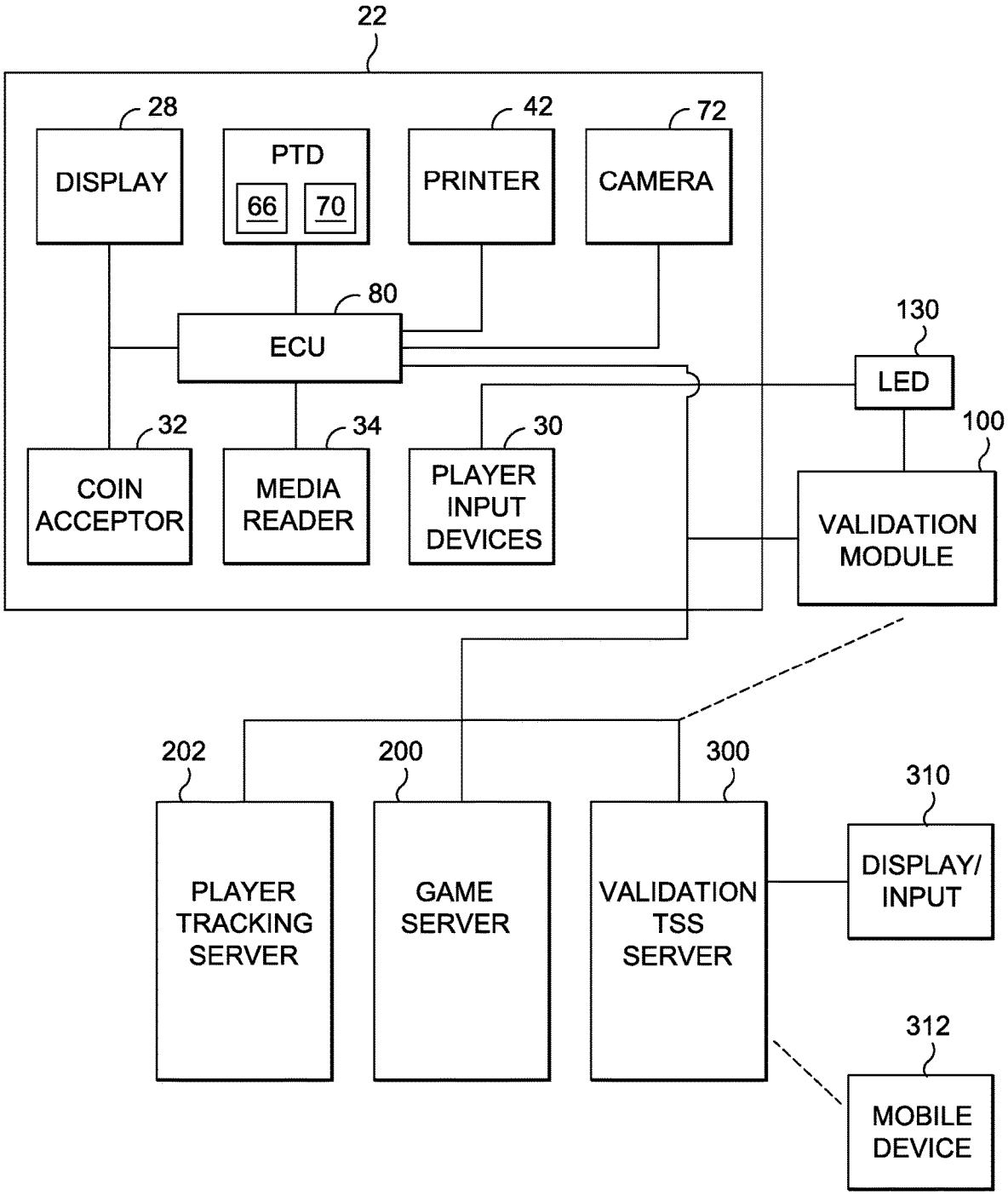
FIG. 2 illustrates a schematic of a gaming machine according to one exemplary embodiment.

One configuration of a gaming machine 22 is illustrated in FIGS. 1 and 2. As illustrated, the gaming machine 22 generally comprises a housing or cabinet 26 for supporting and/or enclosing various components required for operation of the gaming machine. In the embodiment illustrated, the housing 26 includes a door located at a front thereof, the door capable of being moved between an open position which allows access to the interior, and a closed position in which access to the interior is generally prevented. The configuration of the gaming machine 22 may vary. In the embodiment illustrated, the gaming machine 22 has an "upright" configuration. However, the gaming machine 22 could have other configurations, shapes or dimensions (such as being of a "slant"-type, "bar-top" or other configuration as is well known to those of skill in the art).

The gaming machine 22 preferably includes at least one display device 28 configured to display game information. The display device 28 may comprise an electronic video display such as a cathode ray tube (CRT), high resolution flat panel liquid crystal display (LCD), projection LCD, plasma display, field emission display, digital micro-mirror display (DMD), digital light processing display (DLP), LCD touch-screen, a light emitting display (LED) or other suitable displays now known or later developed, in a variety of resolutions, sizes and formats (e.g. 4:3, widescreen or the like). The display 28 may be capable of projecting or displaying a wide variety of information, including images, symbols and other indicia or information associated with game play, game promotion or other events. The gaming machine 22 might include more than one display device 28, such as two or more displays 28 which are associated with the housing 26. The gaming machine 22 might also include a top box or other portion. Such a top box might include one or more display devices 28, such as in addition to one or more main displays which are associated with the housing 26. Also, the gaming machine 22 might include side displays (such as mounted to the exterior of the housing 26) and might include multiple displays of differing sizes.

While the display devices may comprise one or more video displays, in another embodiment, the gaming machine 22 may include one or more physical reels capable of displaying game information, such as slot symbols. In such a configuration, means are provided for rotating the physical reels. In one or more embodiments, the means may comprise a mechanical linkage associated with a spin arm, with movement of the spin arm (a "pull") by a user causing the reels to spin. In such an arrangement, the reels are generally allowed to free-wheel and then stop. In another embodiment, electronically controlled mechanisms are arranged to rotate and stop each reel. Such mechanisms are well known to those of skill in the art. In this arrangement, actuation of the spin arm or depression a spin button causes a controller (not shown) to signal the activation of the spin mechanism associated with one or more of the reels. Preferably, the controller is arranged to either turn off the signal to the device(s) effecting the rotation of each or all of the reels or generates a signal for activating a braking device, whereby the reels are stopped. The principal of such an arrangement is described in U.S. Pat. No. 4,448,419 to Telnaes, which is incorporated herein by reference.

As described in more detail below, the gaming machine 22 is preferably configured to present one or more games upon a player making a monetary payment or wager. In this regard, as described in more detail below, the gaming machine 22 includes means for accepting monetary value.

In one embodiment, as detailed above, certain game outcomes may be designated as winning outcomes. Prizes or awards may be provided for winning outcomes, such as monetary payments (or representations thereof, such as prize of credits), or promotional awards as detailed herein. As detailed below, the gaming machine 22 includes means for returning unused monetary funds and/or dispensing winnings to a player.

The gaming machine 22 preferably includes one or more player input devices 30 (such as input buttons, plunger mechanisms, a touch-screen display, joystick, touch-pad or the like). These one or more devices 30 may be utilized by the player to facilitate game play, such as by providing input or instruction to the gaming machine 22. For example, such input devices 30 may be utilized by a player to place a wager, cause the gaming machine 22 to initiate a game, to indicate cards to be held or discarded, to "cash out" of the gaming machine, or to provide various other inputs.

In one preferred embodiment, the gaming machine 22 includes at least one microprocessor or controller (ECU) 80 for controlling the gaming machine, including receiving player input and sending output signals for controlling the various components of the machine 22 (such as generating game information for display by the display 28). The controller 80 may be arranged to receive information regarding funds provided by a player to the gaming machine, receive input such as a purchase/bet signal when a purchase/bet button is depressed, and receive other inputs from a player. The controller 80 may be arranged to generate information regarding a game, such as generating game information for display by the at least one display 28, for determining winning or losing game outcomes and for displaying information regarding awards for winning game outcomes, among other things.

The controller 80 may be configured to execute machine readable code or "software" or otherwise process information, such as obtained from a remote server. Software or other instructions may be stored on a memory or data storage device. The memory may also store other information, such as pay table information. The gaming machine 22 may also include one or more random number generators for generating random numbers, such as for use in selecting slot symbols, cards or other game symbols, and for presenting the game in a random or pseudo-random fashion (e.g. whereby the game is presented in a manner in which the player cannot control the outcome but where the player may or may not provide player input) or based upon skill.

Preferably, the controller 80 is configured to execute machine readable code or instructions which are configured to implement game play. For example, the controller 80 of the gaming machine 22 may be configured to detect a wager, such as a signal from a player's depressing of the "bet one" button. Upon such an event and/or the player otherwise signaling the gaming machine to present the game, the controller 80 may be configured to cause game symbols or other game information to be displayed on the at least one display 28. The controller 80 may accept input from a player of game inputs, such as a request to hold or discard cards, spin reels or the like, via the one or more player input devices of the gaming machine 22.

The gaming machine 22 may be configured to generate and present games in a stand-alone manner or it may be in communication with one or more external devices at one or more times. For example, the gaming machine 22 may be configured as a server-based device and obtain game code or game outcome information from a remote game server 200 (in which event the gaming machine controller may receive game information from the server 200, such as game outcome information, and use that server-generated information to present the game at the gaming machine).

As indicated, the gaming machine 22 is configured to present one or more wagering games. Thus, the gaming machines 22 is preferably configured to accept value, such as in the form of coins, tokens, paper currency or other elements or devices representing value such as monetary funds. For example, as illustrated in FIGS. 1 and 2, the gaming machine 22 might include a coin acceptor 32 for accepting coins. Of course, associated coin reading/verifying devices and coin storage devices may be associated with the gaming machine 22 if it is configured to accept coins. Likewise, the gaming machine 22 might include a media reader 34. Such a reader may be configured to accept and read/verify paper currency and/or other media such as tickets. Of course, in such event the gaming machine 22 may further be configured with one or more paper currency or ticket storage devices, such as cash boxes, and other paper currency or media handling devices (including transport devices).

The gaming machine 22 might also be configured to read FOBs, magnetic stripe cards or other media having data associated therewith and via which value or funds may be associated with the gaming machine 22. Funds might also be associated via other devices, such as electronic transfer via a Wi-Fi or Bluetooth wireless link to a player's smart phone or the like.

In one embodiment, the gaming machine 22 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. For example, upon an award or at cash-out, associated funds may be paid to the player by the gaming machine 22 dispensing coins to a coin tray 40. In another embodiment, funds may be issued by dispensing paper currency. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference. Thus, the gaming machine 22 preferably includes at least one media printer 42. As described below, in accordance with the invention, the media printer 42 may be configured to print and dispense drink vouchers The gaming machine 22 may also include a player tracking device, such as a card reader 66 and associated keypad 70. Such player tracking devices are well known and may permit the game operator to track play of players of the gaming machine. The gaming machine 22 may include one or more communication interfaces or ports to enable the exchange of information or communication with external devices or systems, such an external player tracking host 202 (see FIG. 2), accounting system or the like. For example, the gaming machine 22 may include a primary and a secondary slot accounting system or "SAS" port which facilitates reporting of gaming machine related activity (such as amounts wagered at the gaming machine 22) by the gaming machine to an accounting system.

As illustrated in FIG. 1, the gaming machine 22 might also include at least one image capture device, such as a camera 72. The camera 72 may be configured to capture the image of a player of the gaming machine 22 or other patrons of the gaming establishment who are in the vicinity of the gaming machine 22. As with the printer 42, the camera 72 may be at least partly controlled by the controller 80. For example, the controller 80 may cause the camera 72 to capture one or more images (still images and/or video) and may receive data from the camera 72. As described below, the controller 80 may perform processing on the image data or might transmit the image data to one or more remote devices for processing. In another embodiment, the camera 72 might be associated with a validation module (whereby the camera 72 may be controlled via controller or that module or via the processor or controller of the gaming machine, and whereby the camera can essentially be "retrofit" to a gaming machine which does not natively have such a feature).

It will be appreciated that the gaming machine illustrated in FIGS. 1 and 2 is only exemplary of one embodiment of a gaming machine. For example, it is possible to for the gaming machine to have various other configurations, including different shapes and styles and having different components than as just described.

The gaming machine shown in figures may be configured with or be modified to include a validation module 100. In one embodiment, the validation module 100 comprises at least a visual status indicator, such as one or more lights including incandescent, fluorescent, halogen, LED, OLED, etc.; flags, or other mechanically actuated display mechanisms; a display screen such as a OLED or LCD panel; or any other mechanism for providing a visual indication of a player's validation status as detailed herein. For example, in this embodiment the visual status indicator may comprise at least one LED 130.

As mentioned above, the gaming machine 22 may be connected to a game server 200 through which gaming information is received at the gaming machine 22. The gaming machine 22 might be communicatively coupled to one or more other devices or systems, such as a player tracking server or host 202 of a player tracking system. Such systems are well known and may be used to collect information regarding player or patron activities at a gaming establishment. For example, a player may enroll in a player tracking club at a gaming establishment and be assigned an ID (such as associated with a player tracking ID card). The player's activities at the gaming establishment, such as game play, may be tracked and associated with their ID. The player might be rewarded points or the like, such as based upon their game play (amounts wagered and the like).

A Validation and Time Since Served ("TSS") server may also be provided. The validation module 100 may connect to the Validation/TSS server 300 via the connection with the gaming machine 22, or directly, such as via a wired connection or a wireless connection using any acceptable wireless protocol such as Bluetooth, Wi-Fi, etc. Accordingly, the validation module 100 may operate in a stand-alone fashion, may transmit information to and/or receive operating instruction from the Validation/TSS server 300, or may operate using a combination of both stand-alone operation and remote operation.

As shown in FIG. 2, the Validation/TSS Server 300 may be connected to a display and an input device 310, such as a touchscreen. The display may be used by a host or server to view a status of the validation module 100, to send control instructions to the validation module 100, or the like. Further, one or more mobile devices 312 may wireless connect or communication with the Validation/TSS server 312 to interact with it and/or the validation module 100.

Figure 3:
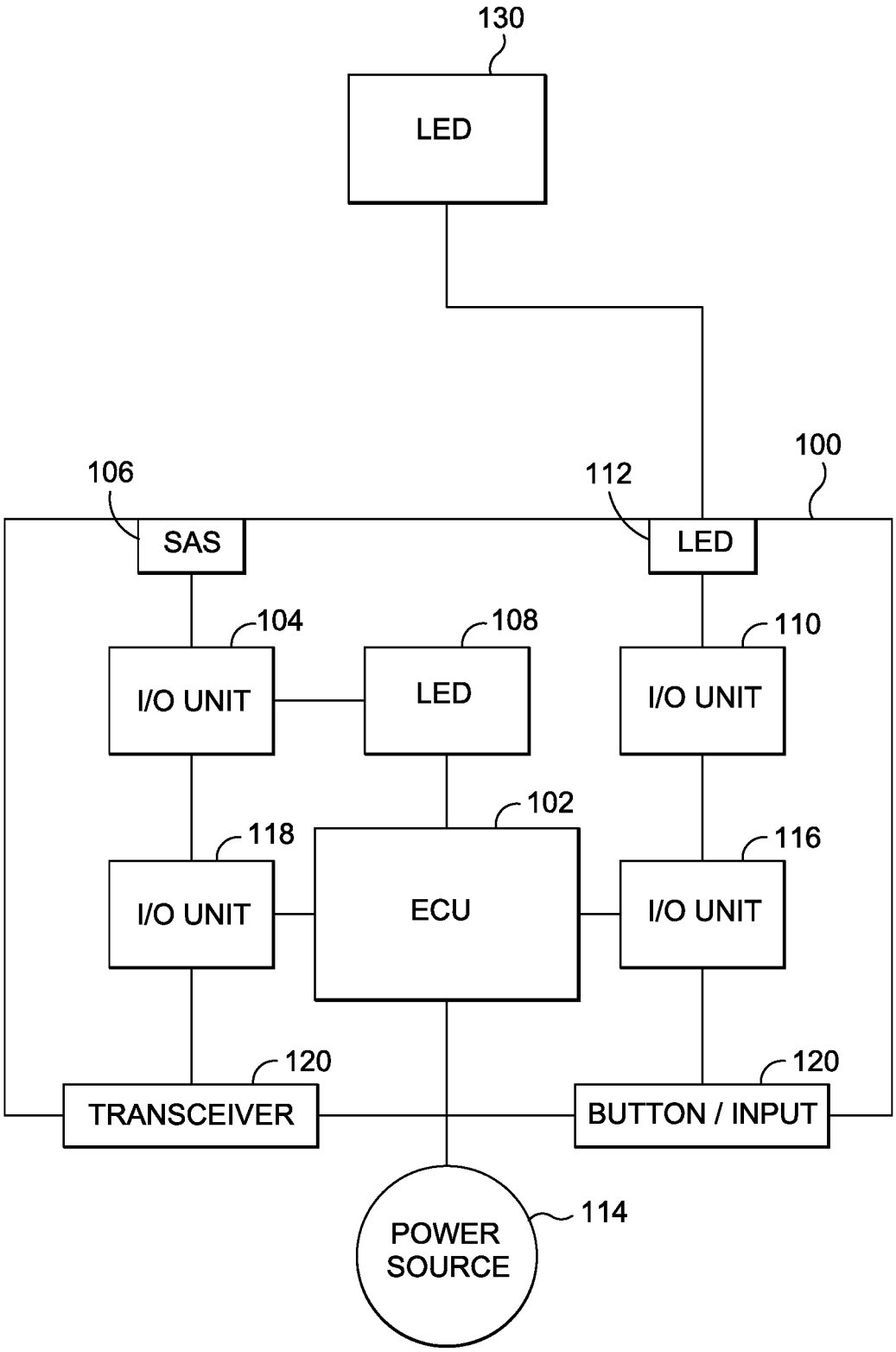
FIG. 3 illustrates a schematic of a patron compensation validation device, according to one exemplary embodiment.

An example of a validation module is shown in FIG. 3. As illustrated, the validation module 100 may comprise an electronic control unit 102. The electronic control unit 102 may comprise a memory (such as for storing data, code/software, etc.) and a microprocessor (for executing instructions, such as machine-readable code stored in the memory). The controller 102 is connected to a plurality of input/output devices 104, 110, 116, 118. One input/output device 104 may be configured to connect the validation module 100 with the gaming machine 22. In this embodiment, the input/output devices 104 is connected to or configured as a SAS port 106 (e.g. is configured to implement a SAS communication protocol and has associated physical connectors for connecting an appropriate cable thereto which leads to a slot accounting system ("SAS" port of the gaming machine). The validation module 100 may thus be connected to the SAS port of a gaming machine 22, thus enabling the validation module 100 to receive information from the gaming machine 22 or from the game server 200 and/or validation/TSS server 300.

In one embodiment, the gaming machine 22 may be connected to an accounting system via its primary SAS port and thus the validation module 100 may communicate with the gaming machine 22 via connection to the gaming machine's secondary SAS port (in one embodiment, if such a port is already utilized, a port sharing feature may be implemented whereby the validation module utilizes and releases the port at certain intervals to share the port with other devices, etc.). Of course, other types of input/output devices 104 might be utilized to facilitate communications with the gaming machine 22, such as to receive information from the gaming machine, including different types of physical connectors or interfaces and utilizing different communication protocols. As one example, the validation module 100 might be configured to communicate with a gaming machine 22 using a system to system ("S2S") protocol. In other embodiments, the validation module 100 may be connected to the gaming machine 22 via other wired and/or wireless connections.

The validation module 100 further comprises an LED port 112 corresponding to the input/output unit 110. The LED 130 is connected to the LED port 112, such that the validation module 100 drives the output to the LED 130. The LED 130 may comprise several LEDs to emit multiple colors (the LED might comprise a LED capable of emitting different colors or multiple individual LED elements capable of emitting different colors). In some embodiments, other light or visual devices may be used in place of the LED without departing from the scope of the invention, as detailed above.

The validation module 100 may further comprise one or more feedback LEDs 108. The feedback LED may be installed on the validation module to provide feedback regarding the functional status of the validation module 100. The validation module 100 is connected to a power source 114, often provided by the gaming device 22.

The validation module 100 may receive data from the gaming machine 22 via the input/output device 104. For example, the validation module 100 receives information generated and output by the gaming machine 22 (such as via its SAS port), such as whether funds were input to the gaming machine 22 (such as coins input to the coin acceptor 32 or bills or monetary value tickets input to the media reader 34), whether a wager was made via an input device 30, and the like.

The validation module 100 further comprises a transceiver input/output unit 118 that connects to one or more wired or wireless transceivers 120. The validation module 100 may connect directly to one or more networks via the transceiver 120. For example, the validation module 100 may connect to the time since served ("TSS") server 300 (FIG. 2) to track when complementary items such as food or drink are delivered to person at a gaming machine.

Another input/output unit 116 connects the ECU 102 of the validation module 100 to a button or other input device 120. This allows input to the validation module 100 installed at the gaming machine 22, for example. The button or other input 120 may be used by a server, bartender, or the like to indicate when an item such as a beverage was served to a person at the gaming machine.

The validation module 100 drives the LED 130 based on the information received at the validation module 100, such as directly input thereto, or received from the gaming machine 22 and/or from the Validation/TSS server 300 via the transceiver 120. For example, once a gaming session is initiated on the gaming machine 22, the validation module 100 may determine whether the activity on the gaming machine 22 has met a certain threshold and/or whether enough time has passed so that the player of the gaming machine meets the requirements to receive service. The validation module 100 may determine that a new player has initiated play at the gaming machine in various manners. For example, a new gaming session may be detected when funds are input to the gaming machine after a long period of inactivity or after a prior "cash out" was performed, or when a new player "cards-in" to the gaming machine by inputting their player tracking card. When the activity meets a certain threshold, then the validation module 100 activates or changes the color of the LED 130. For example, the controller 102 may have setup information stored in a non-volatile memory that stores parameters and thresholds In one embodiment, the validation module 100 allows the gaming establishment to provide complementary items or gifts such as food, beverages, or other items (comps) based on whether patrons are actually playing the gaming machines as compared to patrons who are merely enjoying the atmosphere of the establishment while in a gaming area. The validation module may also track a time since served to provide for regular service to a patron, and to comply with applicable regulations. For example, the validation module may ensure that a host, server, or bartender serves alcoholic beverages at or below a predetermined frequency set by the regulations (whether such service is provided as a comp or is being paid for by the player). The validation module 100 does this by creating a visual cue observable by a host, bartender, waitress, etc. that comps may be issued to certain patrons. In other embodiments, the Validation/TSS server 300 may track the time since service at particular machines or relative to particular players in a centralized fashion. The Validation/TSS server 300 may then send out indicators of when such thresholds have been met to the validation module 100. Also, in such a remote host configuration, an operator may centrally control attributes tracked and displayed at the Validation/TSS server 300 and/or the validation module 100 such as a time threshold for service, for example, based upon time of day or the like, or depending upon which item is being served.

The validation module 100 preferably receives information from the gaming machine 22 regarding activities occurring at the gaming machine. In one embodiment, this information may comprise or include information concerning the funds which the player has associated with the gaming machine (such as via input of value tickets, coins and/or currency), the amount a player is wagering and/or at what frequency the player is wagering. In one embodiment, the validation module 100 utilizes the information regarding the gaming activity to determine a validation status of the player. At a predetermined level, the validation module 100 may light up the LED 130 or provide another visual cue to notify the host that a player is qualified to receive a comp.

In some embodiments, the LED 130 may be configured to emit a plurality of colors of light that provide a host with additional information about a validation status of a particular player at a gaming machine. For example, the LED 130 may include three or more LEDs including a blue LED, a green LED, and a red LED. In some embodiments, illumination of the blue LED may indicate that a player has associated funds with the gaming machine (such as by input of a ticket, currency, coins, etc.) above a predetermined threshold, alerting a host that the player may be initially eligible, or may soon be eligible for a good or service. Illumination of the green LED may indicate that a player has qualified for or is entitled to such, such as because the player has an average wager-rate above a predetermined level. Illumination of the red LED may indicate a secondary validation or qualifying status, such as a "top tier" player status, such as when the player's average wager-rate is higher than a second predetermined level which is greater than the first level. This player may receive greater value awards or awards (whether such are free or reduced-price goods/services) at an increased frequency.

The levels set for a qualified player, a top tier player, or any other service or award level may be programmed into the validation module 100 as desired by the gaming establishment. In one example, the levels may be set based upon an average wager-rate over a given time period. For example, the required wager rate may be $X wagered during a three-minute time period. Periodically, the total value of the wagers placed during a time period are calculated and a wagers-per-minute value is determined and compared to the parameter stored in the memory of the validation module 100. For example, the parameter may be $4.00/minute, or one game every fifteen seconds with a $1.00 bet. Intervals in which the parameters are calculated may be averaged to provide an average which must be maintained above the threshold for the player to be eligible for an award. For example, award or service entitlement might require a player to wager $1 per minute on average during 5-minute intervals. The validation module 100 might determine that the player wagered $5 in the first 5-minute window, $1 in the next 5-minute window and then $20 in the next 5-minute window. The validation module 100 might be configured to average the wagers per time during the intervals to validate the player for an award or service even though the players wagering in the second 5-minute window (of $1) was insufficient, given that the player's overall wagering during the second interval, averaged to include the prior and later intervals ($26/15 minutes) was higher than the threshold.

Other criteria (including calculations) may be utilized to determine whether a player is entitled to an award or service. For example, the parameter may be set to a predetermined amount wagered regardless of the time in which it takes to achieve the amount, a frequency of wagering without a specified amount wagered for each game, or the like.

The validation module 100 may also be configured to motivate a player to achieve certain play levels to be eligible for an award or service. For example, the validation module 100 may flash the LED light 130 as a warning to a player that the player is in jeopardy of losing their entitlement or status unless he or she increase his or her game play. A host may also remind a player that he or she can remain eligible if they continue to play at the gaming machine. Further, the LED light may begin to flash when a player has almost achieved a threshold level for an award or service, motivating the player to continue playing.

A method of operating the validation module 100 to will be described with reference to FIG. 4. In step 402, a validation module is installed relative to one or more gaming devices. For example, as described above, a validation module 100 is installed at a gaming machine 22, such as by location of the module 100 at or near the gaming machine with a connection to the SAS port thereof. In step 404, one or more thresholds are programmed into or set at the validation module. Such thresholds may include a predetermined amount wagered, an average amount wagered over time, etc. Different levels for receiving different types or amounts of awards may also be set.

In step 406, the validation module receives gaming information from the gaming device about the game play on the gaming device. For example, the validation module may receive information about funds associated with the gaming machine by a player and amounts wagered at the gaming device. Step 406 may be ongoing throughout a gaming session at the gaming device or may be completed periodically.

In step 408 it is determined whether the gaming activity meets one or more predetermined thresholds. Based upon this determination, one or more visual indications of validation status may be provided. In one embodiment, if a player is not validated for or entitled to an award or service, a visual indication of such status could be provided. Preferably, if a validation threshold is met, then the validation module 100 provides a visual notification that the player is eligible, as in step 410. For example, the validation module may light a green LED to indicate to the host the player at the gaming device has met a first level of eligibility or may light a red LED to indicate that the player has met a second or higher level of eligibility. If the gaming activity does not meet a predetermined threshold, then the method proceeds to step 412.

In step 412, it is determined whether the gaming activity is within a predetermined range of the threshold. When the gaming activity is not within a predetermined range, the method may return to step 406 to continue monitoring the gaming information. When the gaming activity is within a predetermined range, the method proceeds to step 414.

In step 414, it is determined whether the player at the gaming device was previously eligible. If so, in step 416, the validation module provides a visual indication that the player is losing his or her qualification for an award or service. For example, the validation module may cause the red LED to flash to notify the player directly or for the host to remind the player, that he or she is losing a level, and that the level may be regained through increased wagering activity.

When it is determined in step 414 that the gaming device was not previously qualified for an award or service the method proceeds to step 418. In step 418, the validation module may provide a visual notification that the player is almost qualified. The validation module might, for example, cause the green LED to flash to indicate to the player or host that the player is close to achieving a qualified level. After steps 416 and 418, the method returns to step 406 to continue monitoring gaming activity.

In one embodiment, the method may include other steps. For example, when a player associates funds with a gaming machine, the validation module may evaluate the amount of funds which were provided to the machine. If the amount of funds exceeds a threshold, a visual indication might be provided. For example, a blue LED might be illuminated. The host might then provide an initial comp to the player or then closely monitor the module in anticipation that the player may shortly achieve the first or base threshold eligibility which is based upon actual amounts wagered.

Several advantages may be gained by using the system, device, and method described herein. For example, by implementing the invention described herein, a gaming establishment can reduce the distribution of excessive complimentary gifts, such as food or beverages, without confirmation that minimum thresholds of entitlement have been met. With the visual indications such as the LEDs that may turn on, off, and blink, the operator can set validation or entitlement thresholds which must be met and be provided with visual indications of entitlement. This makes it possible for bartenders, hostesses and other personnel to know when a player is or is not entitled to comps.

The thresholds may be determined by the validation module in real time to validate the wagering at the gaming devices which allows for a more structured approach to issuing complimentary gifts. This allows the gaming establishment to save money to assure that minimum wagers for receiving complementary gifts or awards are being met before issuing such gifts. Further, hosts or bartenders no longer have to guess whether a particular player is eligible for such free gifts (such as by trying to simply watch a player to see if they are wagering at a machine or just sitting at the machine, etc.).

Further, the disclosed embodiments encourage more play at the gaming machines than would otherwise take place. This is due to the real-time notification to both the hosts and players of whether the player has met a level for complimentary gifts or awards. When the LED flashes that a player is in jeopardy of losing a compensation level or that a player is close to receiving comps, the player is encouraged to wager more to maintain their comp privileges.

It will be appreciated the validation module may include other or additional features. For example, the validation module may interface with a mobile device and an application on a mobile device of a player to provide the player with a real-time information on a qualification level for receiving complementary gifts. Such information may also be relayed through a gaming network to hosts or bartenders on a computing device such as a computer or mobile device. This allows the host or bartenders to see in real time where players in the gaming establishment are located that are eligible for an award or service. The validation module might also communicate with externals systems, such as an external host, such as to report validation status information, etc. to the host. The host might communicate with other systems, such as a bar's POS system which tracks information regarding drinks which are distributed or the like, such as to link actual comps or rewards to determined validation status. Such information may be useful to confirm that drinks or other comps are only being delivered when a player qualifies, to confirm the rate of comp delivery to rate of wagering, etc., to further validate the cost of the comps to the host to the income which is being received from the players.

In other embodiments, the host or bartender may be able to "reset" the validation module after providing a player with an award or otherwise serving the player (e.g. whether the award or service is complimentary or paid for). For example, the host may have an application on a mobile device that is interconnected with a plurality of validation modules attached to the gaming machines. When the host provides an award or service to one of the eligible player, the host may reset the validation module for that player. This restarts an eligibility criterion for the player to earn an additional award or service.

Figure 5:
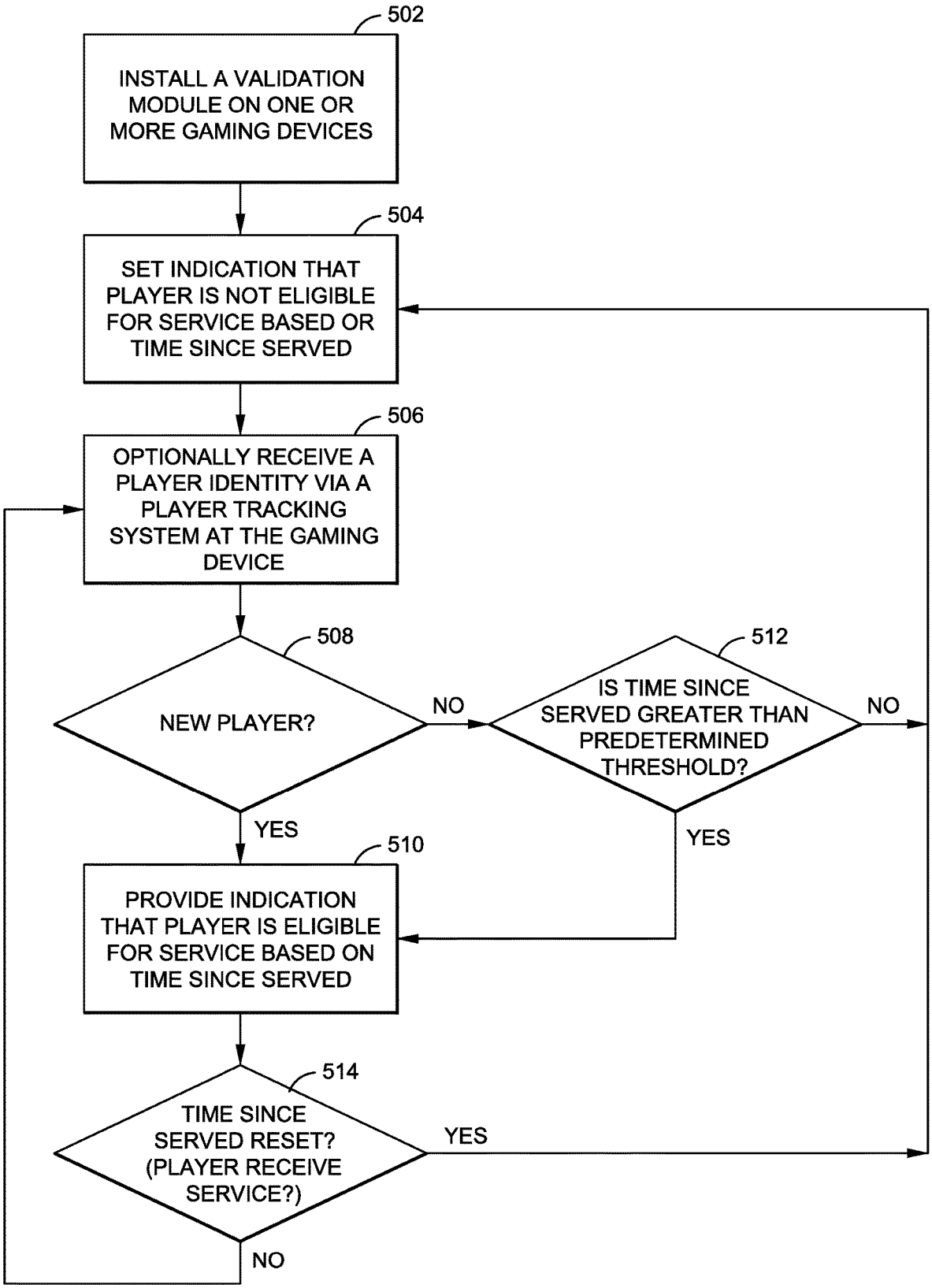
FIG. 5 shows an exemplary process for using a validation module as a time since served module to provide items to a patron.

In some embodiments, the validation module may alternatively track or might also track the time since the patron was last served as another criterion for determining whether a patron is eligible for an award or services. Further, the validation module may track the award or service of certain products, whether the products are served complimentary or are paid for. As mentioned above, a host, bartender, or server may need to track the frequency that alcoholic beverages are served to each patron to comply with local regulations. FIG. 5 shows an exemplary process for using a validation module as a time since served ("TSS") module to provide items to a patron.

In step 502, a validation module is installed relative to one or more gaming devices. For example, as described above, a validation module 100 is installed at a gaming machine 22, such as by location of the module 100 at or near the gaming machine with a connection to the SAS port thereof. However, the validation module used as a TSS may also be installed in other environments, such as at tables at a restaurant, seats at a bar, etc.

When used is such environments, the validation module may have other configurations. For example, the validation module may be configured as a stand-alone device, or to integrate with the features of bar-top gaming machines or gaming tables. In a stand-alone configuration, the validation module might include its own card reader so that a player may card-in to the device directly. In a stand-alone configuration, the validation module may include software for implementing the described method. In other embodiments, such as in a networked environment, aspects of the method may be implemented by software executed at a remote host/server (e.g. TSS server 300).

In step 504, the validation module 100 sets an indication that the patron is not eligible for service, such as for a complimentary item, or for a regulated item, based on the TSS. That is, the validation module 100 sets the indication as an initial default setting to show that the patron is not eligible for service.

The indication may be displayed both at the validation module 100, and at a remote host device. For example, the validation module 100 may be configured such that the ECU 102 controls the LED 130 or other visual indicator associated with the validation module 100 to display an indication that the patron at the gaming machine 22 is not eligible to be served a product based on TSS. For instance, the LED 130 may show a certain color, may flash a certain pattern, etc. In one embodiment, a dedicated color of the LED 130 may be used to indicate that the patron is not eligible to be served a product as compared to other colors indicating that the player may be served. For example, the color white may indicate that the patron may not be served based on TSS. This is compared to the LED displaying the color purple to indicate that the patron is eligible for service. Another color, such as yellow, may provide feedback to the user to inform the patron that they are almost again eligible to be served. For example, the LED 130 may remain white during a first half of the required TSS and then may turn yellow during the second half of the required TSS. Once the TSS has elapsed, the LED 130 may turn purple, indicating eligibility for another service.

Further, the validation module 100 sends the TSS status to the Validation/TSS server 300 via the transceiver 120, or through a local gaming network via the SAS 106. The indication may display on the display 310 or on the mobile device 312 of the establishment showing that the patron at that location is not eligible to be served a product based on TSS.

Of course, the Validation/TSS server 300 may centrally track the TSS for the validation module 100 and may send instructions to the validation module 100 to display the indication the patron at the gaming machine is not eligible for service. The display 310 and/or mobile device 312 may show a plurality of locations (e.g., gaming machines) at the establishment and may show each of the TSS status for each location so that the host, server, or bartender may quickly identify which patrons may be served a product, such as a complimentary item, beverage, etc.

In step 506, the validation module 100 optionally receives or confirms a player identity of a patron at the gaming device 22 of location of the validation module 100. For example, the validation module 100 may receive player identity information of a patron via the link with the gaming machine from a player tracking device on the gaming machine and/or the player tracking host 202. In this way, the system may track the play of the patron as well as the items served to the patron while the patron is at the establishment, even if the patron moves from one gaming machine to another gaming machine. For example, the Validation/TSS server 300 maintains a TSS value for a player identity who is identified at a first gaming machine even when the player moves to a second gaming machine is identified at the gaming machine. In other embodiments, the Validation/TSS server 300 integrates with a player tracking server 202 or other existing systems to track the player identity.

In applications where there is no player tracking system, the step may be omitted (e.g. the time since service functionality may be implemented without associating such information with an identified player, but may instead simply be implemented generally), or other identification methods may be used. For example, as described in more detail below, a host, server, or bartender may scan a government issued identification card, may utilize a separate loyalty program, etc. to track the patron at the establishment to ensure that government regulations and internal policies regarding service to the patron may be followed, or an image of the patron might be captured and be used to verify the patron and age.

Next, in step 508, it is determined whether a new patron is at the location of the validation module 100. For example, the system identifies when a new player cards in to a player tracking system. The player tracking system allows the establishment to determine whether the patron who cards in at a gaming machine is a new patron, or whether the patron is not a new patron but has simply moved from one gaming machine or area to another. Where there is no player tracking system, a new player may be detected by wagering activity after a long period of inactivity (e.g., long enough to reasonably know that there is a new player at the game) or by activity after an express cash-out at the gaming machine. In other instances, a new player may be manually entered at the validation module 100 via the button or input device 120. In non-gaming environments, a new patron may be set by user such as bartender upon seeing the new patron arriving to the bar in front of an area associated with the button or input device 120 of the validation module 100 or via an input 310 or mobile device 320 associated with the validation module 100. In other embodiments, as described below, one or more images of a patron or player may be obtained at a gaming machine and that image may be used to verify the patron or player (and, of course, such information may be used to determine/verify when a new patron or player begins play at a particular gaming machines or moves to another/different gaming machine—e.g. a camera may capture images at a gaming machine and those images may capture a player coming to the machine and sitting in front of it and thus detect a new session, and when, for example the player leaves and a new player sits down in the front the machine, the old session could be ended and new one opened for the new player).

If a new player is detected, then the method proceeds to step 510. In step 510, the indication is changed to show that the player is eligible for service based on the TSS. As explained above, this may be indicated at the comp device 100 via the LED 130 and/or via an external device, such as the display 310 or mobile device 312 receiving the information from the validation module 100 via the transceiver 120 or SAS 106, or via the Validation/TSS server 300.

If a new player is not detected in step 508, then the method proceeds to step 512. In step 512, it is determined whether the TSS is greater than a predetermined threshold. For example, the TSS may be maintained at either the validation module 100 or the Validation/TSS server 300. When there is not a new player, the TSS continues to increase for the player. Where, a player has moved from one gaming machine or another, the TSS for the player is attached to the player based on the information maintained at the Validation/TSS Server 300 or via integration with a player tracking system. For example, if the TSS for a player at a first gaming machine is 15 minutes out of a 30-minute predetermined threshold, and then the player moves to a second gaming machine, the TSS at the validation module 100 at the second gaming machine is set to 15 minutes so that there is still only 15 minutes remaining until the threshold is met.

The predetermined threshold may be set according to government regulations or by policies of the establishment. For example, the threshold may be to comply with regulations for serving alcoholic beverages. In other instances, the threshold may be set by a casino to ensure that comps are provided to players no faster than a predetermined frequency. If the TSS is greater than the threshold, the method proceeds to step 510 which is described above. If the TSS is not greater than the predetermined threshold, the method returns to step 504.

Returning to step 510, the player remains eligible to be served until it is determined that the player is served in step 514. In step 514, the validation module 100 monitors whether the TSS is reset. For example, when a player at a casino receives a complimentary item or beverage, the host or server may actuate the button or other input 120 to reset the TSS. In some embodiments, the TSS might be reset from the mobile device 312 of a server or from a remote location (which device then communicates with the validation module 100 or with the TSS server which in turn communicates with the validation module), such as by a bartender via the touchscreen 310. The TSS might be set as against a particular player via their name as displayed on the touchscreen 310 or mobile device 312, or via selection of a gaming machine as identified by a list or map, or via direct communication with the validation module 100 at the particular machine.

So long as the player has not received service, the TSS is not reset, and the method proceeds back to step 506. That is, the TSS indication remains as eligible until the patron at that location changes or until the TSS is reset. When the TSS is reset upon serving the patron, the process proceeds to step 504 where the indication is reset to not eligible.

Figure 4:
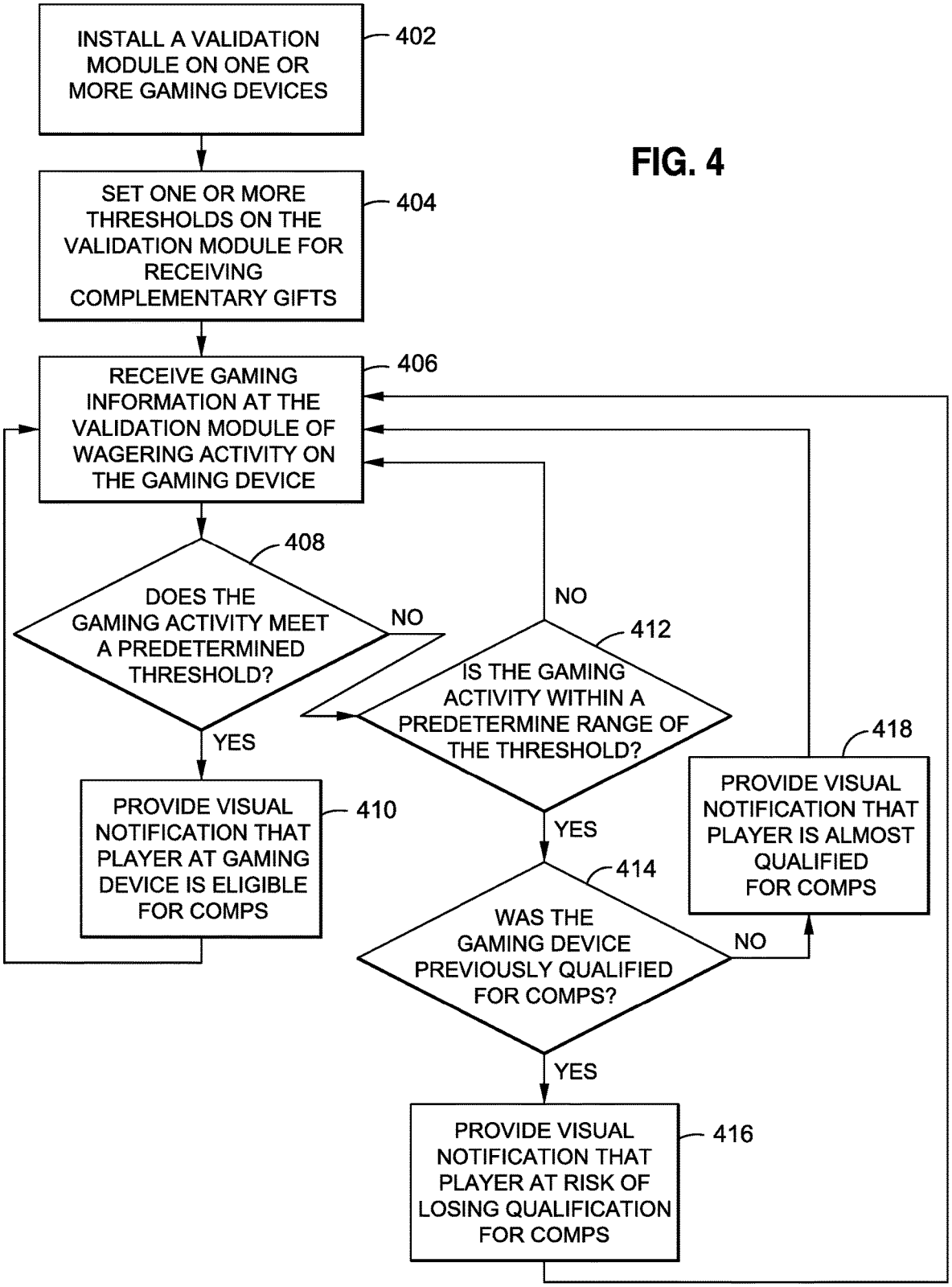
FIG. 4 illustrates a method of patron compensation validation, according to one exemplary embodiment.

It is further noted that the methods described in FIGS. 4 and 5 may operate simultaneously to determine whether a player is eligible for complimentary items or other goods or services. For example, the player may not be eligible until both the gaming activity meets a certain threshold, as explained with reference to FIG. 4, and the TSS meets a predetermined threshold, as explained with reference to FIG. 5. In other embodiments, a combination of the methods explained with reference to FIGS. 4 and 5 may be used simultaneously to determine what is served to a patron. For example, the establishment may provide any type of complimentary items such as discounted or free show tickets, food items, gaming credits, or discounted or upgraded lodging so long as gaming activity meets a predetermined threshold. In contrast, complimentary items such as alcoholic beverages may only be served if both the gaming activity and the TSS meet predetermined thresholds.

In such embodiments, the LED 130 may, for example, comprise multiple LEDs. A first LED may indicate eligibility based on a TSS. For the example, the first LED may display different colors depending on whether the patron is eligible for service (e.g. purple for eligible, white for ineligible, and yellow for almost eligible, as explained above). A second LED may display eligibility based on gaming activity (e.g. green for compensation level achieved, peach and light blue for just under compensation level, red for compensation level not achieved, and pink for premium level, such as ten times a compensation level). Of course, as noted above, in one embodiment instead of having LEDs which can illuminate in different colors, a plurality of different LEDs could be provided and then be selectively illuminated and/or other types of indicates may be provided. Also, in this embodiment where one or more LEDs are used to provide information regarding TSS and one or more other LEDs are used to provide eligibility based upon game play or other activity, the operator might turn off or disable either the TSS functionality or the eligibility based upon game play functionality of the validation module, in which case the associated LED(s) would not be utilized or operate.

In yet further embodiments, the TSS attaches to the type of complimentary item given to a player, so that different complimentary items are served to the player. For example, when the player is eligible for complimentary items and is awarded bonus gaming credits, and TSS for the bonus gaming credits is reset so that the next time the player is offered a complimentary item, the server or host can see that the player is not eligible for additional bonus gaming credits, but should be given a different complimentary item.

Likewise, the time since service functionality may be implemented independent of any other comp validation status functionality. For example, if validation status based upon game play is not utilized, only service time might be tracked and utilized per the TSS functionality. In such an embodiment, it is possible for the validation module 100 to not be connected to the gaming machine in a way that it obtains or tracks game play information. As indicated above, relative to TSS functionality, the validation module might simply be linked to the gaming machine or a player tracking module thereof to obtain player identification information, or the TSS functionality might simply be implemented "anonymously" relative to a player of a gaming machine (e.g. without knowing their identity).

In one embodiment, validation status is dependent upon or determined by an amount of funds associated with a gaming machine and/or amounts wagered by the player over time. Other information or criteria might be utilized, such as based upon tracked player game play.

In one embodiment, the validation module 100 may be programmable or customizable by the operator, such as to set different validation parameters. In one embodiment, the validation module 100 might be modified from the remote Validation/TSS server 300 which is connected to the validation module 100. For example, an operator might be provided with an application or interface at the remote Validation/TSS server or via the mobile device 312 connected to the Validation/TSS server which includes an interface which allows the operator to select various validation parameters. These are then communicated with the processor of the validation module 100 to program or implement the selected parameters.

In another embodiment, the processor might be provided with dip switches or similar input devices which the operator can select to implement different operating parameters which are pre-programmed into the module. For example, there may be seven on-board dip switches that allow the user to configure the board to set threshold parameters. The dip switches may be labeled 1-7. Dip switch 1 may set a minimum funding level (bills, coins, tickets, etc. associated with the machine) to control a blue qualifier LED. Dip switches 2, 3, and 4 may set a minimum-dollars-played-per-minute to control a green qualifier LED. Dip switches 5 and 6 may set an interval (in minutes, seconds, etc.) for the green qualifier LED. Dip switch 7 may set a multiplier of the threshold to qualify as a top tier player to control the red qualifier LED. Example configurations are shown in Tables 1-4 below.

TABLE 1

| Dip Switch 1 (Blue Qualifier) | | |
|---|---|---|
| On | Off | Minimum Wager |
| X | | $20 |
| | X | $10 |

TABLE 2

| Dip Switches 2-4 (Green Qualifier) | | | | | | |
|---|---|---|---|---|---|---|
| Dip Switch 2 | | Dip Switch 3 | | Dip Switch 4 | | |
| On | Off | On | Off | On | Off | Min Wager Per Minute |
| | X | | X | | X | $1.00 |
| X | | | X | | X | $2.00 |
| | X | X | | | X | $3.00 |
| X | | X | | | X | $4.00 |
| | X | | X | X | | $5.00 |

TABLE 2-continued

| Dip Switches 2-4 (Green Qualifier) | | | | | | |
|---|---|---|---|---|---|---|
| Dip Switch 2 | | Dip Switch 3 | | Dip Switch 4 | | |
| On | Off | On | Off | On | Off | Min Wager Per Minute |
| X | | | X | X | | $6.00 |
| | X | X | | X | | $7.00 |
| X | | X | | X | | $8.00 |

TABLE 3

| Dip Switches 5-6 (Time Intervals) | | | | |
|---|---|---|---|---|
| Dip Switch 5 | | Dip Switch 6 | | |
| On | Off | On | Off | Interval Minutes |
| | X | | X | 3 |
| X | | | X | 6 |
| | X | X | | 9 |
| X | | X | | 12 |

TABLE 4

| Dip Switch 7 (Red Qualifier) | | |
|---|---|---|
| On | Off | Hot Player Multiplier |
| | X | 5 |
| X | | 10 |

The validation module 100 as described above has the particular advantage that it may be used with an existing gaming machine 22 without modifying the gaming machine 22. Modifications to the gaming machine 22, and particularly the code which the machine runs, is associated with regulatory issues. In one example, the validation module 100 is housed in a housing which can be mounted to the exterior of the gaming machine or otherwise be located adjacent to the gaming machine 22. The validation module 100 might, for example, be located on top of the machine so that it is visible to a hostess in a casino environment, or it might be located at the top of the machine or on an adjacent bar surface (such as to be closer or more visible to a bartender). The validation module 100 merely needs to be coupled to a power source (such as an external power source or a gaming machine's power source) and the gaming machine's communication port (such as its SAS port). In this manner, existing or "legacy" gaming machines which do not include any of the functionality described herein can easily be modified or retrofit to provide that functionality.

In one embodiment, the visual indicator(s) are mounted to or are part of the validation module 100. Of course, other configurations might be utilized. For example, the validation module 100 might comprise a small processing unit or box which is positioned at one location (such as at the back of the gaming machine or even within the housing of the gaming machine to be protected from tampering) and a secondary unit or box with which the visual indicators are associated. The secondary unit or box may be located where it is easy to see, such as at the top of the gaming machine 22. Of course, the validation module 100 does not need to be mounted directly to a gaming machine 100. For example, as indicated above the validation module 100 (or at least the visual indicating portion) may be located on or in the bar, such as at the rear of the gaming machine when the gaming machine is a bar top unit.

Of course, it is possible for a gaming machine 22 to be custom manufactured or modified to include the functionality herein. For example, a validation module might be integrated into a gaming machine by locating the processor and the like inside of the gaming machine housing. The visual indicator(s) might be integrated into the gaming machine 22, such as by having LEDs protrude through openings in a top or the side of the gaming machine housing or by having the LEDs associated with a light bar or other feature which is integrated into the gaming machine. In addition, the validation processing may be integrated into the machine, such as by providing game code which the gaming machine's controller directly executes and then controls the associated visual indicators at the machine. In other embodiments, the processing could even be done remotely, such as via a remote host. For example, in one embodiment, a single "validation host" might be provided at a bar. This host might communicate with each gaming machine at the bar and a visual indicator device at each gaming machine. The host may process gaming related information from each machine and then control the visual indicator(s) at each machine. In other embodiments, one or more existing devices of the gaming machine 22 may be used to provide the visual indicators. For example, in one embodiment, the validation module 100 might send a signal the controller 80 of the gaming machine 22 to cause the controller 80 to display validation information on the display 28 of the gaming machine (such as in a border portion thereof).

In the above examples, the systems and method have been described primarily with the use of a casino gaming machine. However, the system and method may also be applied to other gaming environments, such as a player station at casino gaming table or the like. For example, a casino gaming table may define a plurality of player positions. A validation module may be provided relative to each position (or at least visual indicators may be provided relative to each position). The validation module(s) at the gaming table may communicate with a table host, a dealer input device or the like, such as to receive information regarding a player's game play at the gaming table (such as monetary buy-ins, wagers placed via chips or the like, etc., which information may be obtained at the table by dealer input, chip tracking and/or various means). The validation module may then provide a visual output relative to each player at the gaming table as to their validation status and thus their entitlement to awards or service.

Other embodiments of the invention comprise systems, methods and devices for facilitating patron payment for beverages in a gaming establishment. One embodiment of the invention comprises a casino beverage voucher system. Another embodiment of the invention comprises a casino beverage payment system which includes one or more mobile payment devices.

Figure 6:
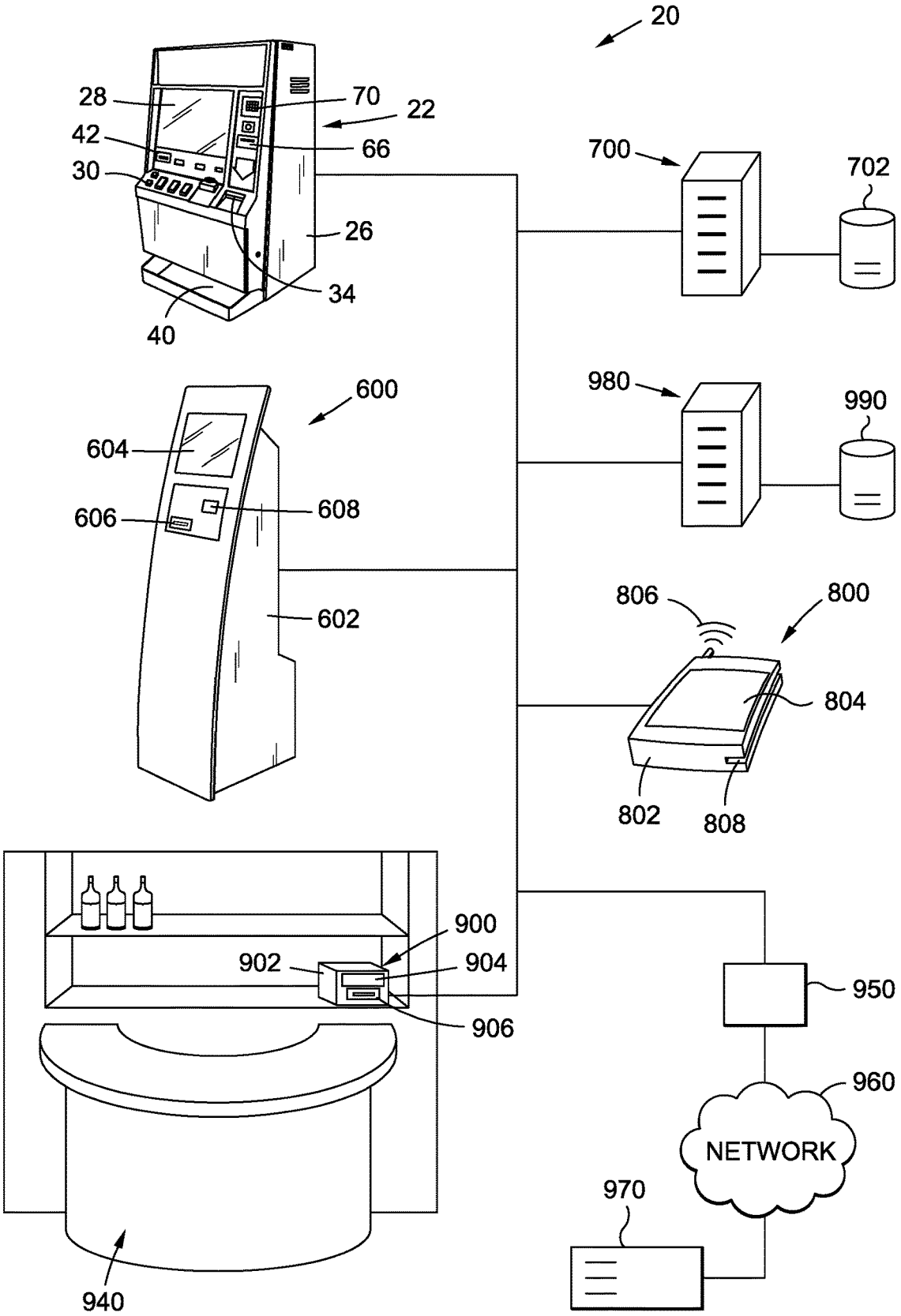
FIG. 6 illustrates one embodiment of a casino beverage voucher system.

FIG. 6 illustrates one embodiment of a system 20 of the present invention. The system 20 comprises a beverage payment system for a gaming establishment. The system 20 may comprise various features or components. In one embodiment, the system 20 comprises one or more gaming machines 22. The gaming machines 22 may be similar to those described above and may, but are not required to include, the validation features described above, such as a comp validation module 100.

As illustrated in FIG. 6, the system 20 may include a kiosk 600. The configuration of the kiosk 600 may vary. In one embodiment, the kiosk 600 may comprise a housing 602, at least one display device 604 such as an electronic video display, a media printer 606, a media reader 608 and at least one user input device, such as a touchscreen associated with the display device 604 or other inputs devices such as buttons or the like, a controller and a communication interface.

The kiosk 600 is preferably configured to receive patron funds for use in purchasing one or more drink vouchers. For example, the kiosk 600 might include a coin acceptor for accepting coins from a patron, or a bill validator for validating paper currency.

In other embodiments, the kiosk 600 may be configured to read credit cards, ATM cards or other cards or otherwise facilitate various types of monetary transactions (whether cash, credit, via a player's existing bank account, a new credit line, etc. including via electronic funds transfer or the like), such as via the media reader 608 (which might, for example, comprise a magnetic stripe reader, an EMV chip reader, or might comprise a wireless media communication interface). For example, a player might present a bank card at the kiosk 600. The kiosk 600 may communicate with an ATM network for processing a credit or debit transaction. In other embodiments, a player might utilize the kiosk 600 to access funds associated with a mobile wallet, casino account or other source of funds.

In a preferred embodiment, the kiosk 600 is configured to dispense drink vouchers. Details of the drink vouchers are provided below. In one embodiment, the vouchers comprise printed media. In one configuration, pre-printed media may be loaded into the kiosk 600 and then dispensed to a patron upon purchase. In other embodiments, the kiosk 600 generates the vouchers, such as by printing them on paper stock and dispensing them from the media printer 606.

The kiosk 600 may be configured as an ATM type device or have other functionality beyond just drink voucher dispensing capabilities. For example, the kiosk 600 may also be configured to dispense monetary value, such as in the form of paper currency, coins or the like, such as via a requested withdrawal transaction from a bank account.

The controller of the kiosk 600 is preferably configured to control the various peripheral devices thereof (which controller may comprise, for example, a processor which controls the peripherals of the kiosk and is configured to implement the functionality herein, such as by executing machine readable code, such as stored in an associated memory or other medium). The kiosk 600 may be in communication with one or more external devices or systems, as described below, such as via one or more wired or wireless communication links through the communication interface.

The kiosk 600 is preferably at the gaming establishment, such as in a casino area of the gaming establishment. Of course, a gaming establishment might have multiple kiosks 100.

The system 20 further comprises a voucher validation sever 700. The voucher validation server 700 may store information, such as information regarding drink vouchers, such as in at least one associated database 702. The database 702 may be associated with a data storage device (such as RAM, ROM, EPROM, hard drive, flash drive, optical media and associated reader, etc.). In addition, the database 702 or other storage need not be part of the server 700 but may be data storage that is remotely accessible to the server.

The voucher validation server 700 preferably comprises a computing-type device. For example, the server 700 may comprise one or more processors, at least one communication device or interface, and may include one or more additional memory or data storage devices (such as separate from the database(s) 702). In one or more embodiments, the processor(s) is configured to execute one or more instructions, such as in the form of machine readable code (i.e. "software"), to allow the server 700 to perform the functions herein. The software is preferably non-transitory, such as by being fixed in a tangible medium. For example, the software may be stored in the one or more memory devices (RAM, ROM, EPROM, hard drive, etc.). One or more of the memory devices may be read-only. In addition, the software may be stored on a removable medium in some embodiments. In general, the one or more memory devices are used as temporary storage or may be used for permanent or near permanent storage (e.g. storage for long periods of time). For example, the one or more memory devices may be random access memory or cache memory used to temporarily store some information and/or instructions for execution by the at least one processor.

The software may comprise one or more modules or blocks of machine readable code. Each module may be configured to implement particular functionality when executed by the one or more processors, and the various modules may work together to provide overall integrated functionality. Of course, in certain embodiments, it is also possible for various of the functionality to be implemented as hardware, i.e. a processor or chip which is particularly designed to implement various of the functionality described herein.

In one embodiment, the voucher validation server 700 may include one or more input and/or output devices. As one example, an operator of the system 20 might interface with the voucher validation server 700 via a workstation or other device. Such a workstation or the like might comprise a keyboard, mouse, touchscreen, video display or the like, whereby the processor of the voucher validation server 700 may receive information from an operator and/or output information thereto. This allows, for example, an operator of the server 200 to interface with the voucher validation server 700 to upgrade, maintain, monitor, etc., the server or other aspects of the platform.

The communication devices or interfaces permit the voucher validation server 700 to communicate with external devices, networks, systems and the like, such as the devices illustrated in FIG. 6.

As described in more detail below, the voucher validation server 700 may be configured to cause information to be displayed at other devices, such as the gaming machines 20, the kiosks 600 or the like. Such information may comprise one or more graphical user interfaces for interfacing with a gaming establishment patron. As detailed below, the interface(s) may provide information to the patron regarding the process for purchasing one or more drink vouchers.

In one embodiment, the voucher validation server 700 is also configured to receive requests for drink vouchers. In one embodiment, in response to such a request, the server 700 processes the request to generate information regarding a voucher. This information may comprise a unique voucher ID and may include other information such as associated payment information, the time the voucher was purchased, etc. The voucher validation server 700 may transmit this information to the issuing device (which may comprise, as detailed below, a gaming machine 20 or a kiosk 600) for use by the device in issuing the voucher. Preferably, information regarding the generated voucher is stored in the database 702.

As also described in more detail below, the voucher validation server 700 is preferably configured to validate vouchers. In one embodiment, when a drink voucher is presented as payment for a drink, the voucher is validated as payment. This may comprise transmitting information regarding the presented voucher, such as a voucher ID, to the server 700. The voucher validation server 700 may compare the presented information to information in the database 702 to determine whether the voucher is valid (exists, has not been previously redeemed, etc.) and, if valid, permit redemption of the voucher (and then preferably change the status of the voucher to redeemed in the database 702 so that it may not be redeemed again).

In some embodiments, the functionality of the voucher validation server might be combined with other functionality and/or be implemented by other devices. For example, relative to a gaming establishment which operates the validation modules 100 and associated Validation/TSS server 300 (as in FIG. 2), the functionality of the voucher validation server might be integrated with the Validation/TSS server.

The system 20 may include one or more portable or hand-held payment processing units 800. Preferably, the portable processing units 800 includes a housing 802, at least one video display 804 capable of displaying information, at least one input device (such as a touch screen associated with the display 804, or buttons, etc.), a communication interface 806, a media reader 808, a processor, a memory, and software. The portable processing units 800 may be dedicated/special purpose devices or may be general purpose devices which are configured to implement the functionality described herein, such as via particular software which is associated with a memory of the unit 800 and which is processed by a processor thereof and/or via accessories connected to the general purpose devices.

The portable processing unit 800 is preferably configured to process payment information, such as via a patron credit or debit card, financial account transfer, casino account transfer, etc. In some embodiments, the portable processing unit may also be configured to process voucher redemptions. Thus, the media reader 808 may comprise a magnetic stripe reader, an EMV chip reader, a barcode reader, a wireless device reader or the like for reading information from a media element such as a credit or debit card, communication with a patron's mobile device (such as for processing a mobile wallet transaction), a barcode from a drink voucher, or the like.

The communication interface 806 is preferably configured to permit information or data to be exchanged with one or more remote devices, such as the server 700. The portable processing unit 800 might also communicate with external payment processing systems or devices, such as ATM or credit card networks, an ACH clearinghouse or the like, such as for processing payment. As noted, the unit 800 is preferably portable, and thus the communication interface 806 preferably supports wireless communications, such as via 3G, 4G, IMT, GSM, Bluetooth, 802.11xx and/or other protocols now known or later developed.

The system 20 may include one or more validation stations 900. The validation stations 900 may comprise, for example, a housing 902, a processor, a memory, software stored in the memory and executable by the processor, a display device 904 (such as an electric video display such as an LED or LCD display), a media reader 906, and a communication interface.

In one embodiment, the validation station 900 is configured to read a drink voucher. Thus, the media reader 906 may comprise a voucher reader, such as a bar code reading device when the vouchers bear a bar code. Of course, the media reader 906 may have other configurations depending upon the format of the voucher.

The validation station 900 may read information from a presented voucher and transmit information regarding the voucher to the voucher validation server 700 for validation, as described herein. In one embodiment, the gaming establishment may include more than one voucher station 900. For example, at least one voucher station 900 may be provided at locations where drink orders are fulfilled, such as at a bar 940 in the gaming establishment.

The system 20 may include other elements or features, or be linked to other devices or systems. For example, the system 20 may include or elements thereof may be configured to communicate with a gaming establishment accounting system, player tracking system (such as comprising a player tracking host or server 980 and associated player tracking database 990), one or more table games or table game systems, or the like.

As illustrated in FIG. 6, the system 20 may include a gateway 950 which facilitates communications between the system 20 and remote or outside systems. The gateway 950 might comprise, for example, a communication interface and include firewall or other features. The gateway 950 may be communicatively coupled to one or more external networks 960, such as the Internet, thus facilitating communication with external devices or systems such as financial payment networks or clearinghouses 970, banks or the like.

Figure 7:
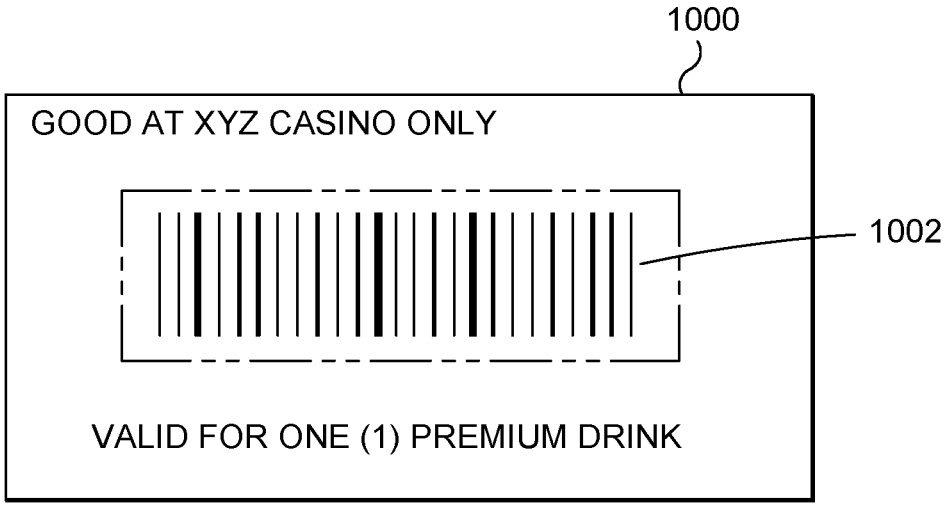
FIG. 7 illustrates a voucher in accordance with an embodiment of the invention.

FIG. 7 illustrates one embodiment of a drink voucher 1000 in accordance with the invention. In one embodiment, the drink voucher 1000 comprises a media which bears information. The media might comprise, for example, paper or card stock. The information might be associated with the media in various manners, such as by printing, encoding of a magnetic stripe or the like. In one embodiment, the information comprises a bar code 1002, such as a one or two-dimensional code. However, the information might have other forms, such as an ID code (numbers and/or letters) or other information. Preferably, the information uniquely identifies the voucher. For example, the bar code 1002 may represent a unique voucher ID number.

Of course, the drink voucher 1000 might include other information. Such other information might comprise information regarding where the drink voucher 1000 may be redeemed (such as the name of the gaming establishment at which the voucher may be presented), the value of the voucher (such as what sort of drink the voucher 1000 may be redeemed for or a monetary value or the like).

Additional aspects of the invention will be appreciated from a description of aspects of a method of the invention. One embodiment of a method of the invention will be described with reference to FIG. 8. In a first step S1, a patron of a gaming establishment may optionally pre-purchase one or more drink vouchers.

For example, a patron may travel to a kiosk 600 or gaming machine 20, provide monetary value (such as via a mobile wallet transaction, via a credit or debit card, via a bank account, a casino account, credits associated with a gaming machine, or the like) and obtain one or more drink vouchers. In one embodiment, the patron may provide input to initiate voucher purchase, such as by selecting a "purchase drink voucher" option which is displayed at the kiosk 600 or gaming machine 20.

In one embodiment, the kiosk 600 or gaming device 20 is configured to display one or more graphical user interfaces to the patron. In one embodiment, graphical user interface(s) may be generated by the kiosk 600 or the gaming device 20, or might be generated by the validation server 20 for transmission to those devices for display.

One example of a graphical user interface and a process of purchasing a voucher will be described with reference to FIGS. 9A-9D. As illustrated, the graphical user interface 1100 is preferably displayed on a video display (such as the display 28 of the gaming machine 20 or the display 604 of the kiosk 600). The graphical user interface 1100 may display various information.

Figure 9A:
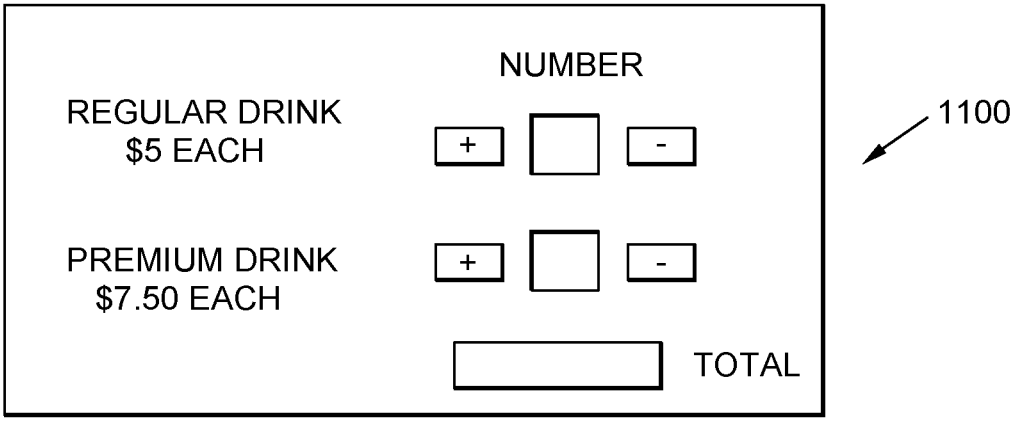
FIGS. 9A-9D illustrate graphical user interfaces in accordance with embodiments of the invention.

As illustrated in FIG. 9A, the graphical user interface 1100 might display the option for the patron to select one or more different types of drink vouchers to purchase, such as "Regular" drinks at a first price and "Premium" drinks at a second price. As illustrated, the patron may be permitted to select the number of such vouchers to purchase, such as via player input. Of course, the patron might be presented with various purchasing options other than those which are illustrated.

Figure 9B:
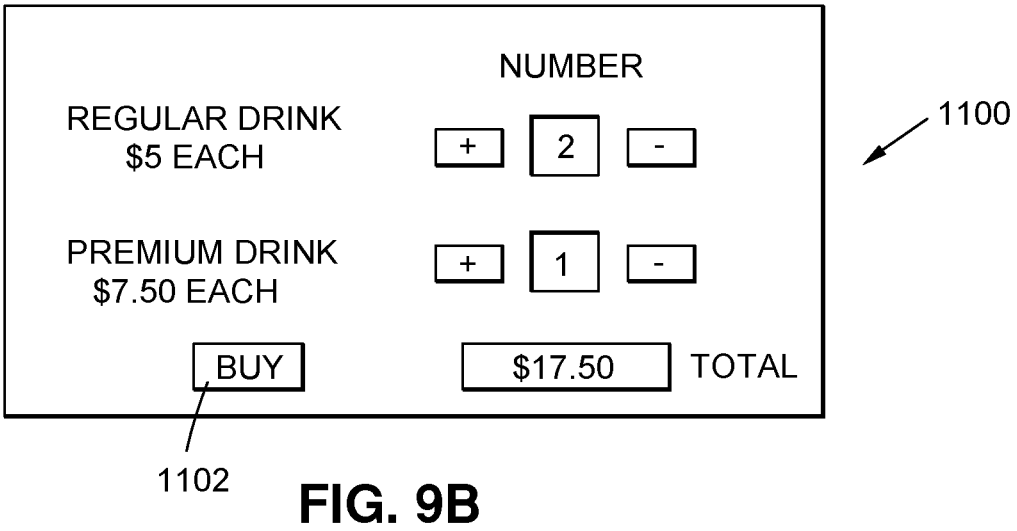

As illustrated in FIG. 9B, the patron has elected to purchase two (2) Regular drink vouchers and one (1) Premium drink voucher. As illustrated, the graphical user interface 1100 may be updated to show a total price for the drink vouchers and a confirmation from the patron that they wish to purchase/buy the selected vouchers, such as via a "BUY" button 1102.

Figure 9C:
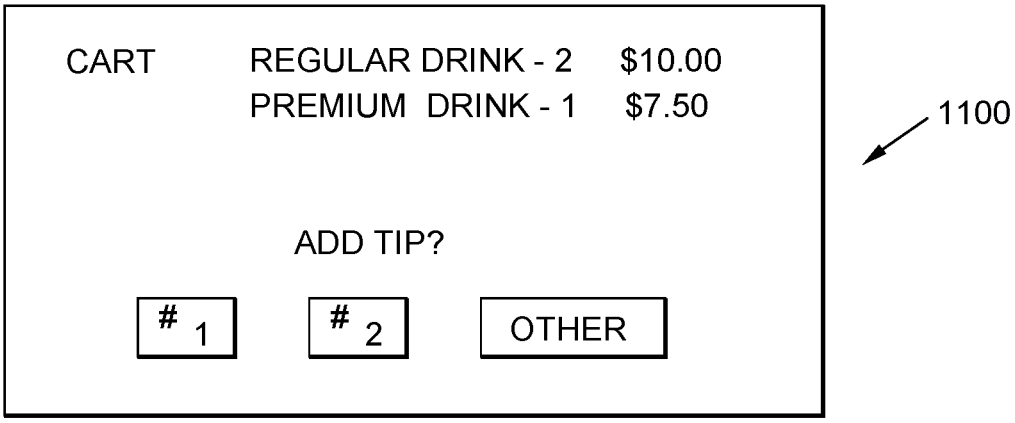

In one embodiment, as illustrated in FIG. 9C, the patron might be presented with other options. For example, the patron might be presented with an option to add a tip to their purchase, such as a tip associated with each purchased drink voucher. As illustrated, the patron might be permitted to select from pre-designated tip amounts or enter their own tip amount.

Figure 9D:
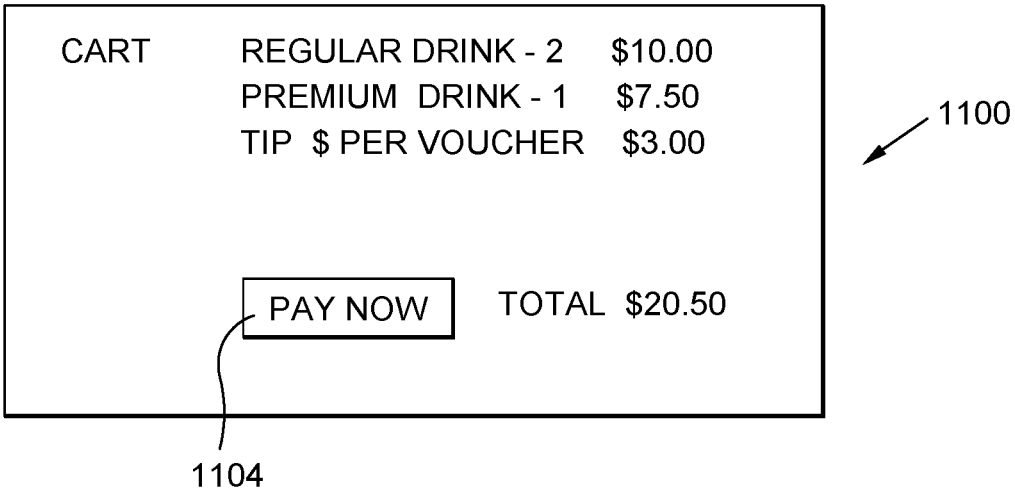

As illustrated in FIG. 9D, the graphical user interface 1100 may then display a total amount due (for the drink voucher(s), tip(s) and/or other optional purchases). The patron may then engage in a payment process, such as initiated by a PAY NOW input button 1104 or the like. Upon elected to pay, the patron may be presented with various options for payment, such as to "pay from gaming machine credits" when the player is at a gaming machine 20, to pay by credit card, debit card, wallet, casino account or the like. Upon selecting a particular form of payment, the patron might be prompted to swipe their debit or credit card (such as via the media reader 608 of the kiosk 600 or the reader 66 of the gaming machine 10) or to input account information, pay with cash, gaming machine credits or the like.

Preferably, when a player elects to purchase one or more drink vouchers, information is transmitted from the gaming machine 20, kiosk 600 or other device for payment processing. In the case of a casino account or gaming machine credits, the payment processing may be effectuated via an accounting system of the casino. In the case of debit and credit cards and bank accounts, the payment might be processed by an external payment processing network or clearinghouse 970 (STAR, ACH, etc.). Of course, in some embodiments, payment information might be transmitted first to the validation server 700 and the validation server 700 might facilitate the payment processing, such as through an external payment processing network.

Once payment has been confirmed, in a preferred embodiment the validation server 700 preferably generates voucher information. This may comprise, for example, generating a unique ID for each voucher. The validation server 700 may then create and store a record corresponding to each voucher, such as a record which ties the voucher ID to the type or price of the voucher, the payment information for the voucher, the time/date that the voucher was generated and/or other information. The validation server 700 may then transmit information to the kiosk 600 or gaming machine 20 to cause those devices to dispense the purchased voucher(s). This may comprise, for example, instructions to cause a media printer of those devices to print information on media (such as to print the voucher ID (or corresponding bar code) onto media stock) and then issue the voucher to the patron. Of course, this process may be repeated for each purchased voucher.

In step S2, customer service is provided to the patron. For example, a patron who is playing a gaming machine 20 might hit a "service" key or a server may walk through the gaming establishment and approach patrons regarding their desire for a drink.

In a step S3, if a patron desires a drink, it may first be determined whether the patron is entitled to a complimentary drink—e.g. one for which the patron is not required to pay. For example, relative to a gaming machine 22 which includes a comp validation module 100 as described above, this might be determined by the server viewing the LED 130 (as at step S410 of the flow diagram of FIG. 4). Of course, other systems and devices might be alternatively utilized.

If it is determined that the patron is entitled to a complementary drink, then the patron may be served the drink or drinks, as at step S4. This may comprise a server travelling to a bar and obtaining the drink and delivering it back to the patron. Relative to the validation system noted above, once the patron has obtained one or more complimentary drinks, the system may reset and the patron may need to engage in additional wagering activities or the like in order to be entitled to yet another complimentary drink at a later time.

If the patron is not entitled to a complimentary drink, then in step S5, it is determined if the patron wishes to tender a drink voucher 1000 in order to obtain a drink. If the patron desires a drink but does not have a drink voucher 1000, then in step S6 the patron may be required to obtain one—such as from a kiosk 600 or a gaming machine 20 in the same manner as that which is described above.

If the patron already had pre-purchased a drink voucher 1000 as at step S1, or after purchasing one in step S6, the patron may tender the voucher or vouchers as payment for the desired drinks. In one embodiment, a patron may be required to tender the correct drink voucher for the particular drink order. For example, as noted, certain drinks may be categorized as "Regular" drinks which are obtainable using a "Regular" voucher and such vouchers may have a first price. Other drinks might be categories as "Premium" drinks and require payment using either more than one Regular voucher or a Premium voucher or the like.

Once the patron has provided the one or more drink vouchers 1000, the vouchers are validated, as at step S7. In one embodiment, this may comprise the server taking the patron's drink order and associated drink voucher(s) 1000 and then travelling to the bar 940 or other service location. The voucher(s) 1000 may be presented to a validation station 900. In particular, each voucher 1000 may be read by the validation station 900 (such as by presenting the voucher to a bar code scanner). The bar code or other information from the voucher 1000 may be transmitted from the validation station 900 to the voucher validation server 700 for validation.

Alternatively, the server may redeem the voucher via the mobile processing unit 800. The server may scan the voucher(s) 1000 with the mobile processing unit 800 to read the voucher(s) 1000 (such as by scanning the voucher with the media reader 808). The bar code or other information from the voucher 1000 may be transmitted from the mobile processing unit 800 to the validation server 700 for validation.

As described above, the voucher validation server 700 may compare the received voucher information to information in the database 702 to determine whether the voucher is authentic/exists, to confirm that it has not already been redeemed, and to confirm the value of the voucher (such as to confirm that it is a "Regular" or "Premium" level voucher). If the voucher cannot be authenticated or it has already been redeemed, the voucher validation server 700 may transmit a message back to the validation station 900 or mobile processing unit 800 to indicate that the voucher is invalid and must be rejected (at which point the patron's drink order would not be fulfilled unless the patron provided another valid voucher or other payment). If the voucher is validated, the voucher validation server 700 may transmit confirmation back to the validation station 900 or mobile processing unit 800 which may then display such to the customer service representative. At that point, the patron's drink order may be fulfilled, as at step S4.

In an embodiment where drink fulfillment is tracked (such as using a drink dispensing system which monitors the fulfillment of drinks), such a system may be linked to the system 20. In this manner, drinks which are provided to patrons who provided vouchers as payment may be linked to those vouchers. This aids in ensuring that customer service personnel are not serving drinks without payment.

The system and method of the invention have numerous advantages. One advantage is that servers do not need to carry cash, provide change or the like, in order to facilitate payment exchange with patrons of a gaming establishment for the purchase of drinks. The system is also advantageous to patrons who can simply purchase vouchers at a variety of locations—including via gaming machines, using various payment methods. This is particularly advantageous given that patrons already have to provide funds to a gaming machine in order to fund wagering at the gaming machine. The patrons can even pre-purchase vouchers rather than have to pay a customer service representative at the time a drink is ordered.

Other embodiments of the invention are contemplated. In one embodiment, instead of a player purchasing a voucher 1000 at a gaming machine 22 or other gaming device that they are playing, the player might provide funds which are then processed by the comp validation module 100 to cause the validation module 100 to indicate that the player is entitled to a drink. In this configuration, the player might use credits from a credit balance at the gaming machine or insert or provide funds such as cash, coins, or funds from a casino or bank account or the like to again fund the beverage. The funds may be credited by the comp validation module 100 to indicate the player is entitled to a drink (such as by causing a green LED to illuminate).

In one embodiment, the monetary value that the player must pay to obtain the drink may vary, such as depending upon a base-line "credit" that the player has earned, such as for play at the gaming machine. For example, assume that a player must wager $100 in order to qualify for a free $5 drink. If the player has not wagered anything, the player may be required to pay $5 in order for the comp validation module 100 to indicate that the player is entitled to a drink. On the other hand, if the player has wagered $50 (and is thus still not entitled to a free drink), the player might only be required to pay $2.50 in order for the comp validation module 100 to indicate that the player is entitled to a drink.

In one embodiment, one or more interfaces may be provided to indicate to a player the amount that they need to pay to obtain a drink. For example, a "buy drink" button might be displayed on the gaming machine's display 28, such as by the comp validation module 100 (either via direct interface to the display 28 or via the controller 80 of the gaming machine). Upon touching a touch screen associated with the display 28 in the location of that button, the comp validation module 100 may cause information to be displayed to the player which indicates the amount that the player needs to pay to obtain a drink. Of course, other means may be provided for indicating this and related information to the player and for facilitating the player's payment for the drink.

In one embodiment, the comp validation module 100 may be configured to indicate that a player is entitled to more than one drink. For example, the validation module 100 might include two or more green LEDs, wherein a green LED illuminates for each drink that the player is entitled to. In this manner, the player might earn or buy more than one drink and the server can easily determine that the player is entitled to more than one drink. In another embodiment, a single indicator might be utilized, but it might stay active or illuminated to indicate that the player is entitled to more than one drink. For example, a single green LED might be illuminated and the server might provide a first drink to the player. The server might then provide input that indicates that the drink has been provided. The validation module 100 might cause the single green LED to remain illuminated if the player is still entitled to at least one additional drink.

In one embodiment, a patron may be permitted to pay for a drink (partially or wholly) using value other than monetary value funds. For example, as described above, patron may have a casino player tracking account with associated rewards, such as points. The patron might be permitted to use points in order to pay for a drink. As one example, the patron might identify themselves at a gaming machine 22 or kiosk 600, such as using a player tracking ID (such as by scanning a player tracking card with the associated ID, by inputting an ID code, or by providing other identifying information). The gaming machine 22, kiosk 600 or the like, might contact a player tracking server 980 of the casino to determine a number of available rewards points. The device might also indicate to the patron the number of points that they need to utilize in order to pay for a drink (including, as described above, potentially discounted based upon credit for amounts of game play or the like). As one example, the gaming machine 22 or kiosk 600 might indicate (such as on a display thereof), that "you have 1500 rewards points; you can obtain a drink by paying $3.00 or utilizing 600 points," whereupon the patron may provide funds to pay for the drink or utilize points. Of course, if the patron utilizes points, the patron's point balance is reduced. Upon payment, a voucher 1000 is issued to the player or the drink indicator is illuminated or the like.

Figure 8:
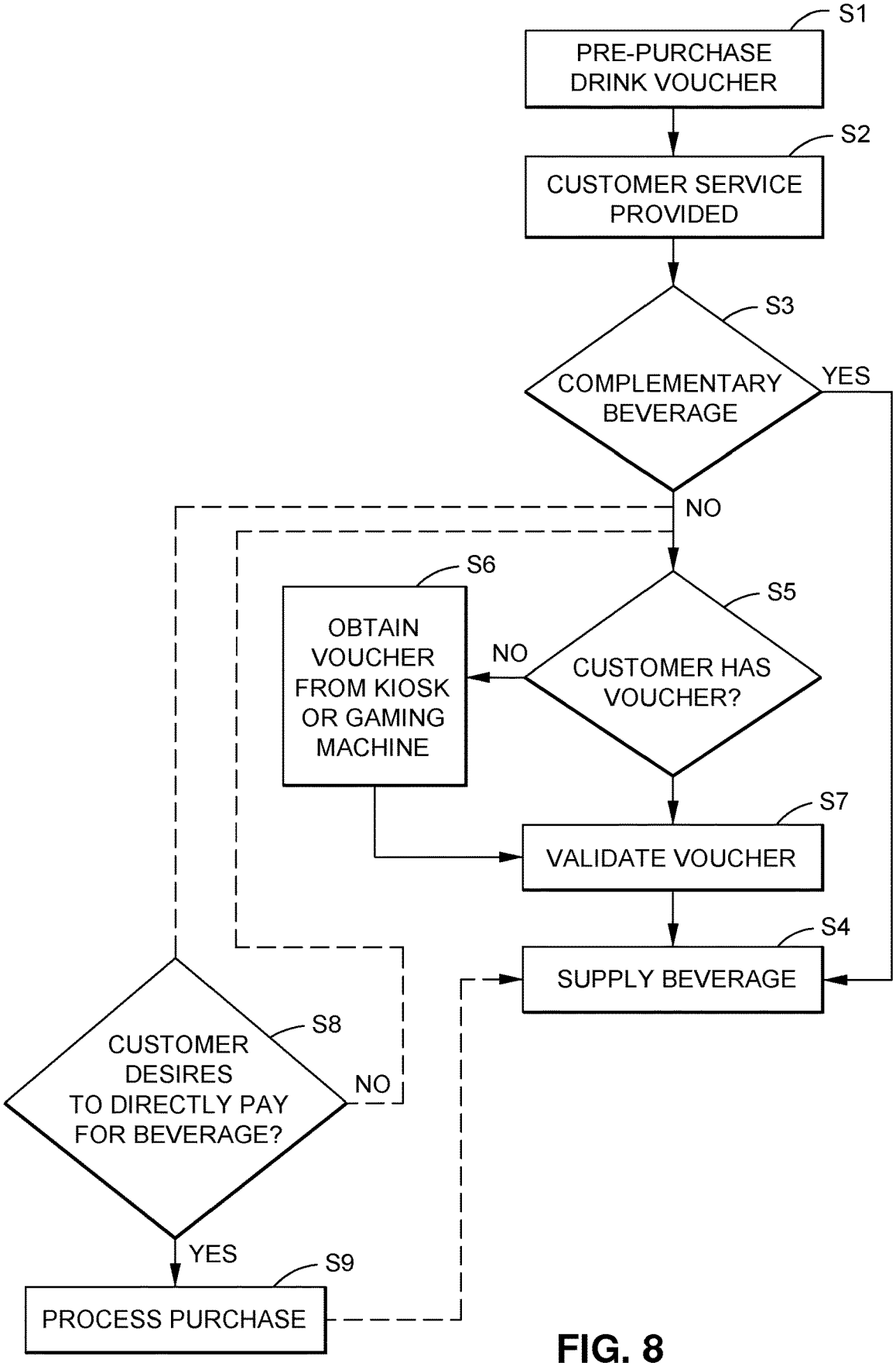
FIG. 8 is a flow diagram illustrating an embodiment of the invention.

In another embodiment, patrons may be permitted to purchase drinks directly from a customer service representative, such as via one of the portable payment processing units 800. As illustrated in FIG. 8, in one optional embodiment, a server may allow a patron to directly pay for a beverage remote from the beverage service location. For example, a server may approach a patron who is at a gaming machine or who is sitting with friends in a lounge area. If the patron is not entitled to a complimentary drink, the patron may be allowed to directly purchase a drink, as at step S8. If not, such as if the patron has one or more drink vouchers, the process may continue as described about at step S5.

However, in this embodiment, if the patron wishes to directly purchase a drink, the patron may do so via the portable payment processing unit 800. The unit 800 may be operated by the server or might be operated wholly or partially by the patron. In one embodiment, information is input regarding the drinks to be purchased and a total price is generated. Then the patron provides payment, as at step S9. As noted above, such might comprise a credit or debit card, mobile wallet, casino account, bank account or the like. For example, the patron may swipe or insert their card or debit card to the media reader 808 of the unit 800. In other embodiments, the patron might provide bank account information, casino account information or the like, in similar manner to that described above relative to the purchase of a voucher. Again, for payment by external accounts, an external processing network may be utilized to facilitate the payment.

Once the payment is complete, the server may fulfill the patron's order as at step S4. This may comprise the server travelling back to the drink fulfillment location (such as the bar 940) to obtain the drink and then deliver it back to the patron.

Of course, the patron might be provided a receipt for the transaction, such as printed via media printer of the unit 800. Also, in one embodiment, the portable payment processing unit 800 may link to a back end accounting system and/or drink service system, such as for linking payment by the patron to a drink order and fulfillment of that order.

In one embodiment, patrons may be provided with information regarding the status of vouchers. For example, drink vouchers might expire. In one embodiment, a patron might be permitted to scan a drink voucher 1000, such as a gaming machine 22 or kiosk 600, to confirm that the voucher is still valid (whereupon the voucher is read and information regarding the voucher is transmitted to the validation server 700 for confirmation that the voucher is still valid). For example, the validation server 700 might transmit information back to the gaming machine 22 or kiosk 600 that indicates that the voucher is expired, or is "still valid until (date)".

In one embodiment, the kiosks 600 may be movable. For example, the kiosks 600 might be mounted on wheels and they might be moved to different locations within the gaming establishment, such as by pushing it from location to location. In other embodiments, the kiosk 600 might be motorized or self-moving in an automated or semi-automated fashion. For example, the kiosk 600 might be configured to move along a designated pathway through the gaming establishment and stop at designated locations, such as close to banks of gaming machines where patrons are located. In this manner, the kiosks 600 might move to a location close to a patron, thus eliminating the need for the patron to travel a long distance to locate and use a kiosk 600.

In some embodiments, the kiosks 600 might further be configured as drink dispensing devices. The kiosks 600 might include automated drink filling mechanisms and be configured to actually dispense a drink upon purchase by a patron.

As described above, in one embodiment, criteria may be applied for causing the validation module 100 to indicate entitlement to a comp. For example, the criteria might comprise a certain level of game play, such as wagering. In other embodiments, a gaming establishment might desire to provide a comp to a player based upon other criteria. For example, a gaming establishment might comp a player with a free drink when they sign up for the gaming establishment's player tracking club, based upon the player coming to the gaming establishment for a promotion, or based upon a high level of past play or the like. In such embodiments, the player might identify themselves using their player tracking card or ID and the player tracking server 202 or Validation/TSS server 300 might indicate to the validation module 100 that the player is entitled to a comp, thus causing the validation module 100 to appropriately illuminate (or in other embodiments, the operator might override the validation module 100 to indicate such).

In some embodiments, the comp validation system, including the validation module 100, might be used for other or additional purposes. For example, the validation module 100 might be configured to illuminate a particular LED or sequence of LEDs to provide other information other that entitlement to a comp. As one example, if a patron has been barred from the gaming establishment, has exceeded a gaming limit (for example, where the player signs up for game play monitoring and game play limits to), the validation module 100 might be caused to illuminate a particular LED or sequence of LEDs, such as to indicate to gaming establishment personnel that they should ask the player to leave, stop gambling or the like. As one example, a player may set a $1000 monthly loss limit for gambling at the gaming establishment. The player's wagering may be monitored via the player tracking system of the gaming establishment. When the player tracking system (such as the host 202 in FIG. 2) determines that the player's limit has been reached, it might send a notice to the Validation/TSS server 300 to cause the validation module 100 at the gaming machine 22 that the player is playing to illuminate the appropriate LED(s) to indicate that gaming establishment personnel should stop the player from further gaming.

As described above, in some embodiments of the invention, an identity of the player or patron is utilized in the determination of comp status or validation or for other purposes, such as by using a player tracking ID. However, methods and devices may be used to determine the identity of a player of a gaming machine or other gaming establishment patron. For example, as illustrated in FIG. 1, a camera 72 may be used to capture the image of a player or patron. The image(s) might be transmitted from the gaming machine 22 to one or more external devices for identity determination. As one example, the player tracking database 990 might include a picture of each player that is a member of the player tracking club. An image captured by the gaming machine 22 might be compared to the images in the database 990 to identify a particular player. Of course, the captured image information might also be transmitted to external systems for comparison, such as a state ID database. As one example, such an identification might be used to verify that a person sitting at a gaming machine is a valuable patron of the gaming establishment and that even without that player playing the gaming machine or providing their player tracking ID to the gaming machine 22, the patron should be provided one or more comps (such as by causing the validation module 100 at the gaming machine at which they are sitting to appropriately illuminate).

In one embodiment, image capture technology may be used for other purposes, such as to establish that a player is old enough to drink (and thus old enough to either be awarded a free drink or buy a drink). As one example, the camera 72 may again capture an image of the patron or player and that image may again be compared to information stored in one or more databases in order to identify the player. Such a database may store information regarding the age of the person or the age of the person might be determined from other databases based upon a known identity of the person. Again, as one example, the image information might be transmitted to a remote state ID database which contains images of drivers, their names and ages.

When the player or patron is confirmed to be of drinking age, then the validation module 100 may be caused to illuminate in a particular manner identifying such. However, if the age of the player or patron cannot be confirmed, the validation module 100 may be caused to illuminate in a different manner, thus indicating to gaming establishment personnel that they should check in the ID of the player or patron to confirm their age.

As one example, Validation/TSS server 300 might determine that based upon game play, a player is entitled to a free drink. The Validation/TSS server 300 might cause the validation module 100 to illuminate a green LED for this purpose. At that time, the Validation/TSS server 300 or validation module 100 might cause the gaming machine 22 to capture an image of the player using the camera 72. This image might be used to try and identify the player and their age. If the player's age is confirmed, the Validation/TSS server 300 might cause the validation module 100 to illuminate a second blinking green LED. If, however, the player's age cannot be confirmed automatically, the Validation/TSS server 300 might cause the validation module 100 to illuminate a yellow blinking LED (in addition to the green LED), which yellow blinking LED indicates that the server should manually confirm the player's age.

Of course, various technology might be used to compare captured image data to stored image data for purposes of identifying a player/patron. For example, facial image recognition software might be used for this purpose.

Further, the image capture and identification process might be used in other manners and for other purposes. For example, in one embodiment the image capture and identification process might be used to identify players or patrons who may not even be members of the player tracking club. As one example, a gaming establishment might simply maintain a database of pictures of important patrons. The image capture devices at the gaming machines 22 (or at other locations) might be used to determine that such an important patron is at the establishment, such as for awarding a comp.

Various embodiments of the invention have been described with reference to the award and/or distribution of drinks. Of course, aspects of the invention might be applicable to the purchase of other goods or services (food items or the like, as one example) or the awarding of such as "comps."

Various functionality has been described herein as being implemented by validation module 100 or Validation/TSS server 300. Of course, that functionality might be implemented in other fashions or by either or both of those devices.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A casino beverage payment system comprising:

at least one gaming machine, said gaming machine comprising a housing, at least one player input device, a display device, a voucher dispenser, a controller and machine readable code stored in a memory an executable by said controlled to present, based upon a wager placed by a player of said gaming machine, at least one wager-based game, one or more outcomes of said wager-based game comprising a winning outcome having an associated award;

a kiosk, said kiosk comprising a housing, funds accepting device, a display device, at least one user input device, a controller and a voucher dispenser;

a beverage voucher validation server, said validation server comprising a controller, a memory, machine-readable code stored in said memory and executable by said controller, and a voucher database;

a beverage voucher validation station, said voucher validation station comprising at least one voucher reading device;

at least one communication link between said at least one gaming machine and said voucher validation server, said kiosk and said voucher validation server and said voucher validation station and said voucher validation server;

wherein in response to receiving at said beverage voucher validation server a player's input to said gaming machine to purchase a first beverage voucher, said beverage voucher validation server generates information regarding said first beverage voucher, stores said information in said voucher database and causes said voucher dispenser of said gaming machine to dispense said first beverage voucher to said player;

wherein in response to receiving at beverage voucher validation server a patron's input to said kiosk to purchase a second beverage voucher, said beverage voucher validation server generates information regarding said second beverage voucher, stores said information in said voucher database and causes said voucher dispenser of said kiosk to dispense said second beverage voucher to said patron;

wherein in response to receiving information regarding the reading of said first beverage voucher at said beverage voucher validation station, said beverage voucher validation server validates said first beverage voucher relative to said information stored in said voucher database for use in determining entitlement of said player to use said first beverage voucher as payment for a beverage; and wherein in response to receiving information regarding the reading of said second beverage voucher at said beverage voucher validation station, said beverage voucher validation server validates said second beverage voucher relative to said information stored in said voucher database for use in determining entitlement of said patron to use said second beverage voucher as payment for a beverage.

2. The casino beverage payment system in accordance with claim 1, wherein said first and second beverage vouchers each comprise printed vouchers.

3. The casino beverage payment system in accordance with claim 2, wherein said printed voucher bears at least one voucher ID, said voucher ID stored in said database.

4. The casino beverage payment system in accordance with claim 3, wherein said step of validating said first beverage voucher comprises comparing an ID read therefrom to said IDs stored in said database.

5. The casino beverage payment system in accordance with claim 1, wherein said player's input to said gaming machine to purchase said first beverage voucher comprises payment for said first beverage voucher.

6. The casino beverage payment system in accordance with claim 5, wherein said payment is selected from the group consisting of: player rewards points, monetary value credits associated with said gaming machine, and funds provided to said gaming machine.

7. The casino beverage payment system in accordance with claim 6, wherein said funds comprise one or more of: paper currency, coins and electronic funds associated with a wallet, bank or credit account.

8. The casino beverage payment system in accordance with claim 1, wherein said gaming machine further comprises a validation module, said validation module comprising at least one visual indicator.

9. The casino beverage payment system in accordance with claim 8, wherein said at leas one visual indicator comprises at least one light.

10. The casino beverage payment system in accordance with claim 9, wherein said gaming machine further comprises an image capture device configured to capture an image of said player, wherein when said player is not identified using said image, said at least one light is illuminated to indicate that an age of said player must be verified as part of said player's use of said first beverage voucher to pay for said beverage.

11. The casino beverage payment system in accordance with claim 9, wherein said gaming machine further comprises an image capture device configured to capture an image of said player, wherein said at least one light is illuminated to indicate entitlement of said player to a comp when said player is identified using said image.

12. A method of facilitating service of at least one beverage to a player of a gaming machine comprising:

verifying if said player is entitled to a comp beverage based upon a visual indicator at said gaming machine, said visual indicator configured to be activated when criteria are met which entitles said player to a comp beverage;

when said visual indicator at said gaming machine indicates entitlement to a comp beverage, providing a beverage to said player at no charge;

when said visual indicator at said gaming machine does not indicate entitlement to a comp beverage, receiving at least one beverage voucher as payment from said player for a beverage, said at least one beverage voucher issued to said player at a kiosk based upon payment for said voucher at said kiosk or at said gaming machine based upon payment for said voucher at said gaming machine, verifying said voucher by reading said voucher at a validation station which is configured to transmit information regarding said voucher to a voucher validation server for validation, wherein when said voucher is validated by said voucher validation server, providing a beverage to said player.

13. The method in accordance with claim 12, wherein said payment for said voucher at said kiosk or said gaming machine comprises receiving monetary value from said player.

14. The method in accordance with claim 13, wherein said monetary value comprises a plurality of monetary value credits associated with said gaming machine.

15. The method in accordance with claim 12, wherein said payment for said voucher at said kiosk or said gaming machine comprises a plurality of rewards points.

16. The method in accordance with claim 12, further comprising the step of verifying an age of said player before providing said beverage to said player.

17. The method in accordance with claim 16, wherein said step of verifying an age comprises capturing an image of said player with an image capture device, utilizing said image to confirm an identity of said player and determining an age of said player from said identity.

18. The method in accordance with claim 17, wherein said step of confirming an identity comprises comparing at least a part of said image of said player to an image of said player stored in a database.

19. The method in accordance with claim 18, wherein said database comprises an external state ID database including an image of said player and information regarding said age of said player.

* * * * *